US011753262B2

(12) United States Patent
Sawanaka

(10) Patent No.: US 11,753,262 B2
(45) Date of Patent: Sep. 12, 2023

(54) SHEET CONTAINER AND IMAGE FORMING APPARATUS

(71) Applicant: CANON KABUSHIKI KAISHA, Tokyo (JP)

(72) Inventor: Kei Sawanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/352,102

(22) Filed: Jun. 18, 2021

(65) Prior Publication Data

US 2021/0309470 A1 Oct. 7, 2021

Related U.S. Application Data

(63) Continuation of application No. 16/296,053, filed on Mar. 7, 2019, now Pat. No. 11,066,261.

(30) Foreign Application Priority Data

Mar. 20, 2018 (JP) ..... 2018-053467

(51) Int. Cl.
*B65H 1/26* (2006.01)
*B65H 1/04* (2006.01)

(52) U.S. Cl.
CPC ..... *B65H 1/266* (2013.01); *B65H 1/04* (2013.01); *B65H 2402/51* (2013.01); *B65H 2405/1122* (2013.01); *B65H 2511/10* (2013.01); *B65H 2801/06* (2013.01)

(58) Field of Classification Search
CPC ..... B65H 2402/5151; B65H 2402/64; B65H 2405/1122; B65H 2405/121; B65H 2511/10; B65H 2511/11; B65H 2511/12; B65H 1/266; B65H 1/04; B65H 2402/51; B65H 2402/60
See application file for complete search history.

(56) References Cited

U.S. PATENT DOCUMENTS

2018/0346266 A1* 12/2018 Ishida ..... B65H 1/266

FOREIGN PATENT DOCUMENTS

JP 08198458 A * 8/1996
JP 2018138487 A * 9/2018

* cited by examiner

*Primary Examiner* — Luis A Gonzalez
(74) *Attorney, Agent, or Firm* — Canon U.S.A., Inc. I.P. Division

(57) ABSTRACT

A sheet container to contain a sheet includes a support unit including a plurality of engaged portions and supports the contained sheet, a moveable regulation unit that contacts a sheet end to regulate the sheet in position. The regulation unit includes an operating member held by a holding member and a fixing member movable with the operating member covered by a cover. The fixing member is movable between an engaging position at which the fixing member engages with one of the plurality of engaged portions and a non-engaged position at which the fixing member does not engage with one of the plurality of engaged portions. The operating member is engageable with the cover. The regulation unit is kept fixed to the support unit by the fixing member engaging with one of the plurality of engaged portions, with the cover engaging with the operating member.

7 Claims, 18 Drawing Sheets

SHEET CONTAINER AND IMAGE FORMING APPARATUS

CROSS-REFERENCE TO RELATED APPLICATIONS

The present application is a continuation of U.S. patent application Ser. No. 16/296,053, filed on Mar. 7, 2019, which claims priority from Japanese Patent Application No. 2018-053467 filed Mar. 20, 2018, which are hereby incorporated by reference herein in their entireties.

BACKGROUND OF THE INVENTION

Field

The present disclosure relates to a sheet container for holding sheets and an image forming apparatus including the sheet container.

Description of the Related Art

Sheet containers used in image forming apparatus main bodies are capable of holding sheets of various sizes and are configured to regulate the position of sheets stacked in stack units of the sheet containers.

One known example of the sheet containers is a cassette unit configured to be detachably attached to an image forming apparatus main body. The cassette unit includes a regulation unit that regulates the conveying direction of sheets stacked in the stack unit or the widthwise position. The role of the regulation unit is to regulate the sheets stacked in the stacking unit to achieve appropriate sheet conveyance. Since the sheets stacked in the stack unit have various sizes, the regulation unit needs to be moved according to the sheet size.

The regulation unit includes a control lever for the user or serviceman to operate. The fixed state of the regulation unit is cancelled by operating the control lever, so that the regulation unit can be moved. When the operation on the control lever is stopped, the regulation unit is fixed to the position where the operation on the control lever is stopped.

Japanese Patent Laid-Open No. 2016-113300 discloses a configuration in which a control lever is disposed above a regulation unit so that the user can easily recognize and operate the control lever.

SUMMARY OF THE INVENTION

According to an aspect of the present disclosure, a sheet container to contain a sheet includes a support unit including a plurality of engaged portions and configured to support the contained sheet, and a regulation unit movable with respect to the support unit, wherein the regulation unit comes into contact with an end of the sheet to regulate the sheet in position, wherein the regulation unit includes an operating member to be operated, a holding member configured to hold the operating member, a fixing member movable in cooperation with the operating member, and a cover configured to cover the operating member, wherein the fixing member is movable between an engaging position at which the fixing member engages with one of the plurality of engaged portions and a non-engaged position at which the fixing member does not engage with one of the plurality of engaged portions, wherein the operating member is configured to be engageable with the cover, and wherein the regulation unit is kept fixed to the support unit by the fixing member engaging with one of the plurality of engaged portions, with the cover engaging with the operating member.

Further features of the present disclosure will become apparent from the following description of embodiments with reference to the attached drawings.

DESCRIPTION OF THE EMBODIMENTS

First Embodiment

A first embodiment of the present disclosure will be described with reference to the drawings. It is to be understood that the dimensions, materials, shapes, and relative positions of the components described in the following embodiments can be changed as appropriate according to the configurations of apparatuses that incorporate the present disclosure and various conditions. In other words, the scope of the present disclosure is not limited to the following embodiments.

Figure 1A:
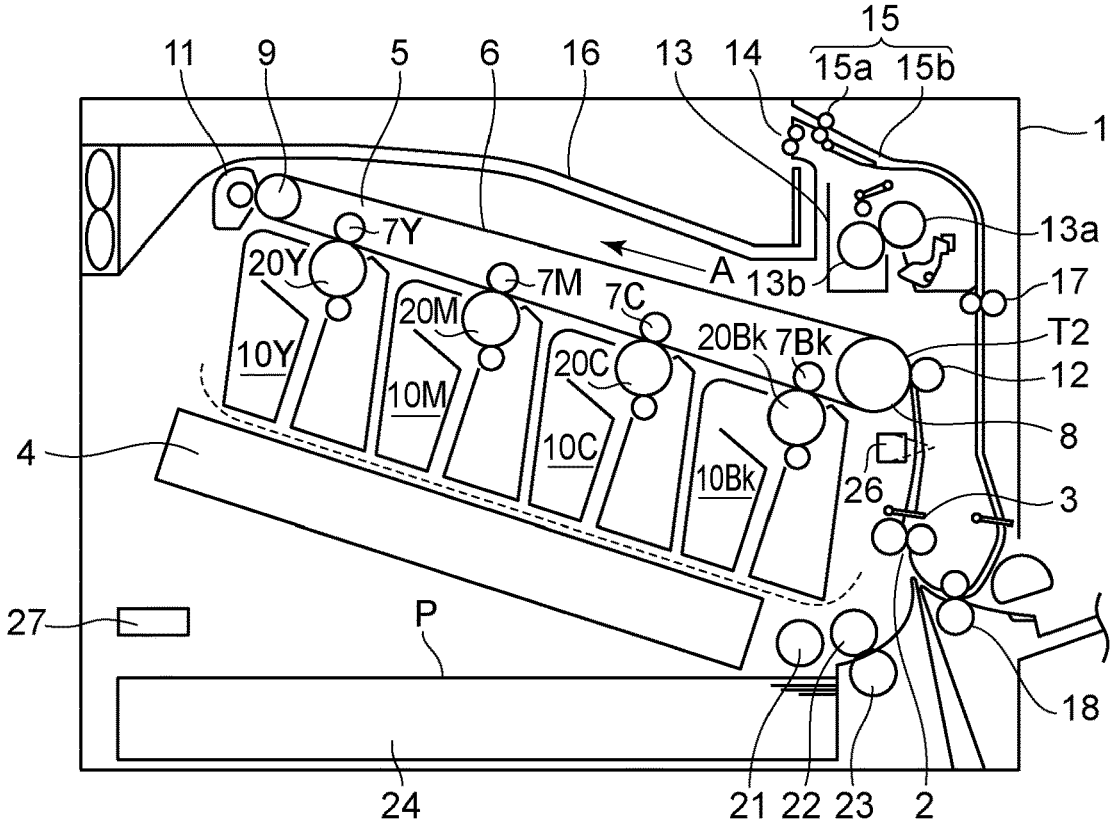
FIG. 1A is a cross-sectional view of an image forming apparatus illustrating the overall configuration.

FIG. 1A is a cross-sectional view of a color electrophotographic image forming apparatus. The present disclosure is not limited to an image forming apparatus 1 that employs an electrophotographic process but may be another type of image forming apparatus, for example, a printer that employs an inkjet image forming process.

Figure 1B:
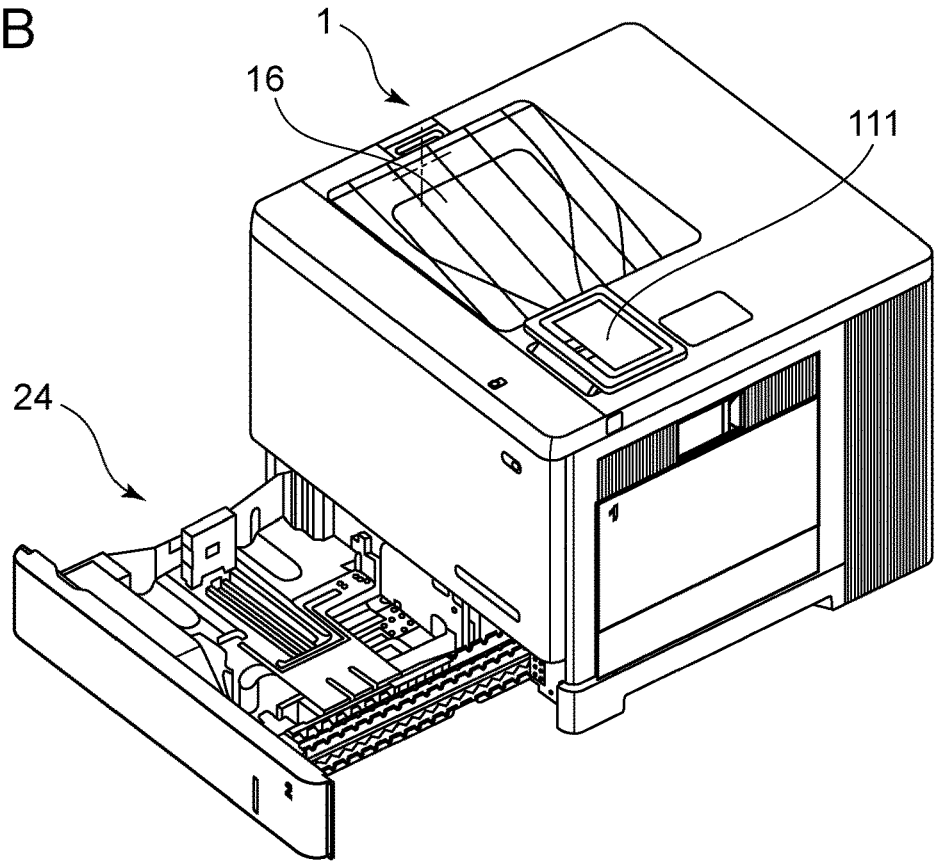
FIG. 1B is a perspective view of the image forming apparatus, from which a cassette, which is a sheet container is drawn.

FIG. 1A is a schematic cross-sectional view of the image forming apparatus 1 (apparatus main body) which is a color laser beam printer illustrating the overall configuration. FIG. 1B illustrates the image forming apparatus 1, from which a cassette 24, which is a sheet container capable of holding a plurality of sheets, is drawn. Referring to FIGS. 1A and 1B, the overall configuration of the image forming apparatus 1, a sheet conveying operation, and an image forming operation will be described.

The cassette 24 is detachably mounted to the lower part of the image forming apparatus 1. Sheets P (hereinafter referred to as sheets) contained in the cassette 24 are fed from the cassette 24 by a conveying roller 21, which is a conveying member. A feed roller 22 and a separation roller 23 are provided downstream of the conveying path from the conveying roller 21. The sheets fed by the conveying roller 21 are separated one by one by the feed roller 22 and the separation roller 23.

A registration roller pair 2 capable of increasing and decreasing the conveying speed of the sheets and a top sensor 3 serving as a detecting unit for detecting the position and the jam of the sheets are provided downstream of the conveying path from the feed roller 22 and the separation roller 23. A medium sensor 26, which is a sheet determination unit, is disposed downstream from the registration roller pair 2 and the top sensor 3.

The leading-end position of the sheet conveyed to the registration roller pair 2 is detected by the top sensor 3 disposed downstream from the registration roller pair 2 in the conveying direction. The registration roller pair 2 increases or decreases the sheet conveying speed based on the detection result of the top sensor 3. The registration roller pair 2 conveys the sheet to a secondary transfer position T2 at the same timing as the timing of a full-color toner image formed in an image forming unit, described later.

The sheet passes by the medium sensor 26 before reaching the secondary transfer position T2. When the sheet passes by the medium sensor 26, the medium sensor 26 detects the basis weight and the surface properties of the sheet to determine the type (properties) of the sheet.

Next, the image forming operation will be described. A scanner unit 4 is provided above the cassette 24. Above the scanner unit 4, four process cartridges 10 (10Y, 10M, 10C, and 10Bk) are provided as the image forming unit.

Above the process cartridges 10 (10Y, 10M, 10C, and 10Bk), an intermediate transfer unit 5 is disposed so as to face the process cartridges 10 (10Y, 10M, 10C, and 10Bk). The intermediate transfer unit 5 includes an intermediate transfer belt 6, primary transfer rollers 7 (7Y, 7M, 7C, and 7Bk) inside the intermediate transfer belt 6, and a driving roller 8 and a tension roller 9 serving as stretching members.

Color toner images formed by the scanner unit 4, photosensitive drums 20 (20Y, 20M, 20C, and 20Bk), and so on are primarily transferred to the intermediate transfer belt 6 rotating in the direction of arrow A (counterclockwise) in FIG. 1A one after another so as to be superimposed. Thus, a full-color toner image is formed on the intermediate transfer belt 6.

Next, how the sheet conveyed from the cassette 24 to the secondary transfer position T2 and the full-color toner image formed on the intermediate transfer belt 6 are secondarily transferred and output as a printed material will be described. Control in image formation on the sheet is performed based on information on the type (properties) of the sheet determined by the medium sensor 26. The control in image formation includes changing the sheet conveying speed, changing the voltage to be applied to the secondary transfer roller 12 at the secondary transfer position T2, and changing the fixing temperature of the fixing unit 13.

A secondary transfer roller 12 is disposed on the right of the intermediate transfer unit 5 so as to face the driving roller 8. A nip formed by the intermediate transfer belt 6, the driving roller 8, and the secondary transfer roller 12 is the secondary transfer position T2.

At the secondary transfer position T2, the sheet is nipped by the intermediate transfer belt 6 and the secondary transfer roller 12 and is conveyed at a constant speed, and the full-color toner image is transferred to the sheet. A cleaning unit 11 collects and accumulates toner remaining on the intermediate transfer belt 6 without being secondarily transferred at the secondary transfer position T2.

A fixing unit 13 is disposed above the intermediate transfer unit 5 and the secondary transfer roller 12. The sheet to which the full-color toner image is transferred at the secondary transfer position T2 is conveyed to the fixing unit 13. The fixing unit 13 presses and heats the full-color toner image transferred to the sheet at the nip formed by a pressure roller 13*a* and a heating roller 13*b* to fix the full-color toner image to the sheet.

A discharge roller pair 14 and a reversing unit 15 are disposed on the upper left of the fixing unit 13. An output tray 16 is used to receive a sheet discharged by the discharge roller pair 14. The sheet to which the full-color toner image is fixed is discharged to the output tray 16 at the upper part of the image forming apparatus 1 by the discharge roller pair 14.

The reversing unit 15 includes a reversing roller pair 15*a* and a flapper 15*b* serving as a branch unit. In duplex printing, the conveying path is changed by the flapper 15*b* serving as the branch unit so as to guide the sheet to the reversing roller pair 15*a*. A conveying path for duplex printing the sheet reversed by the reversing unit 15 is provided. The conveying path for duplex printing is provided with a duplex conveying roller pair 17 and a pre-registration roller pair 18.

As the rotational direction of the reversing roller pair 15*a* changes, the sheet is guided to the duplex conveying roller pair 17 and is further guided to the registration roller pair 2 by the pre-registration roller pair 18. The conveying path ahead of the registration roller pair 2 is the same as for single-sided printing, and the sheet is finally discharged to the output tray 16.

An environment sensor 27 is used to determine the temperature and humidity of the operating environment of the image forming apparatus 1. The temperature and humidity information determined by the environment sensor 27 is used in control in image formation on the sheet. The control is the same as the control based on the information on the sheet type (properties) determined by the medium sensor 26. The specific details of the control include changing the sheet conveying speed, changing the voltage to be applied at the secondary transfer position T2, and changing the fixing temperature of the fixing unit 13.

The image forming apparatus 1 appropriately controls the sheet conveyance and image formation using the information on the sheet type (properties) determined by the medium sensor 26 and the temperature and humidity information from the environment sensor 27. The above is a brief description of the overall configuration, the sheet conveying operation, and the image forming operation of the color laser beam printer. The image forming apparatus 1 may include a touch display 111 serving as both of a control unit and a display unit in the vicinity of the output tray 16 so as to display information on image formation and the cassette 24 and issue an instruction to start image formation.

Figure 2:
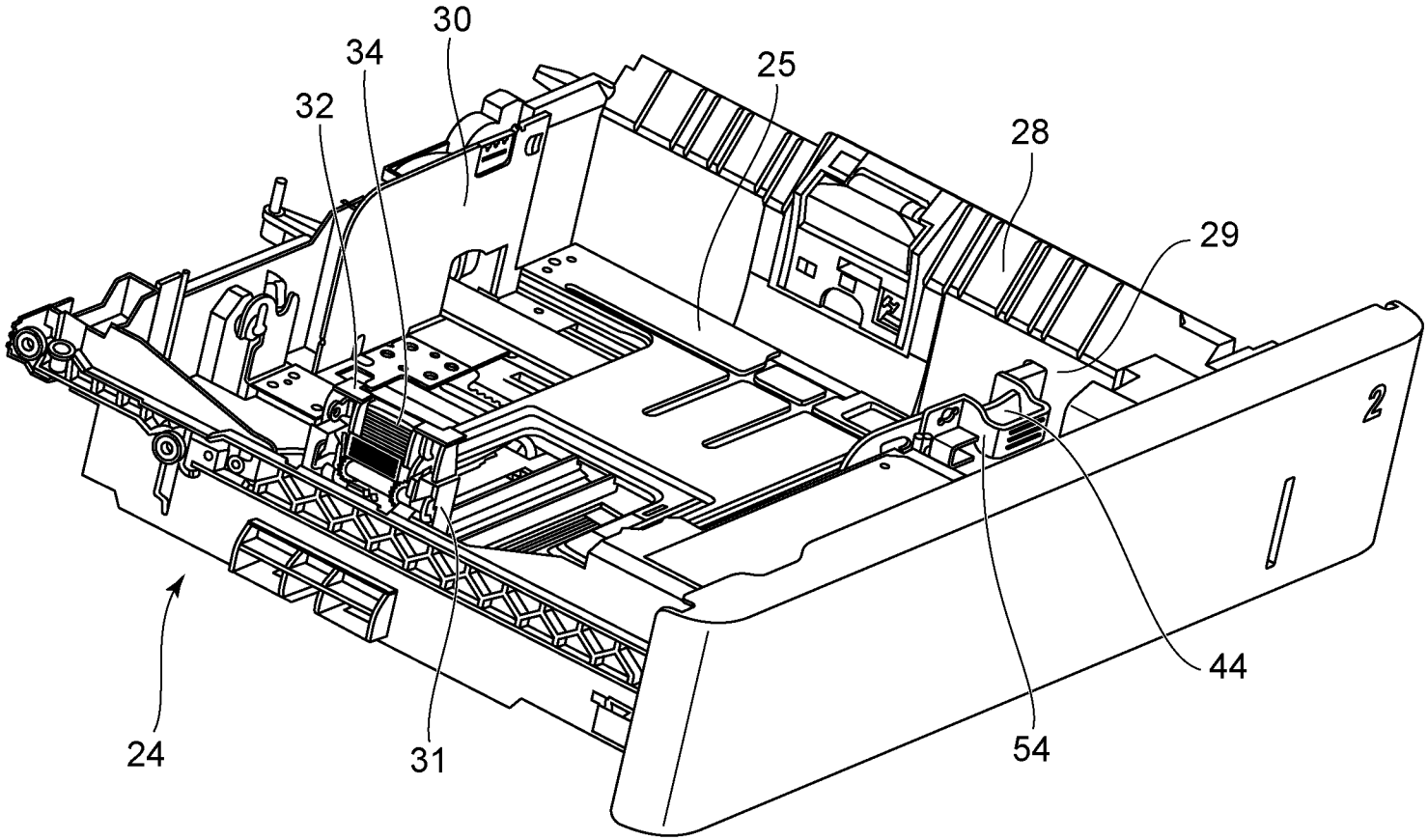
FIG. 2 is a perspective view of the cassette.

FIG. 2 is a perspective view of the cassette 24. Referring to FIG. 2, the cassette 24 will be described. The cassette 24 principally includes a cassette body 28 (a unit main body) whose top is open. The cassette body 28 includes movable width regulation units 29 and 30 that restrict the lateral end positions of the sheet. The cassette body 28 further includes a trailing-end regulation unit 31 that restricts the trailing end position of the sheet so as to be movable with respect to the cassette body 28. In other words, the cassette body 28 is a support unit for supporting the trailing-end regulation unit 31 and the width regulation units 29 and 30. The trailing end of the sheet is based on the sheet conveying direction.

The width regulation unit 29 includes a first control lever 44 and a width regulation holder 54 that supports the first control lever 44. Operating the first control lever 44 allows the width regulation unit 29 to move. The width regulation unit 29 and the width regulation unit 30 are drivingly connected using a rack mechanism (not illustrated). When the operation on the first control lever 44 is stopped, the width regulation unit 29 and the width regulation unit 30 are fixed to positions at which the operation on the first control lever 44 is stopped.

The trailing-end regulation unit 31 also includes a second control lever 34 serving as an operating member and a trailing-end regulation holder 32 that holds the second control lever 34. Operating the second control lever 34 allows the trailing-end regulation unit 31 to move. When the operation on the second control lever 34 is stopped, the trailing-end regulation unit 31 is fixed to a position at which the operation on the second control lever 34 is stopped.

The cassette 24 includes a lifting plate 25 serving as a stack unit. The lifting plate 25 is rotatably supported by a lifting-plate rotation fulcrum 32. The sheets supported by the lifting plate 25 and the cassette body 28 are stacked in the cassette 24 in a state in which the stack position is restricted by the width regulation unit 29, the width regulation unit 30, and the trailing-end regulation unit 31. AS the cassette 24 is mounted into the image forming apparatus 1, the sheets are also guided into the image forming apparatus 1.

Figure 3B:
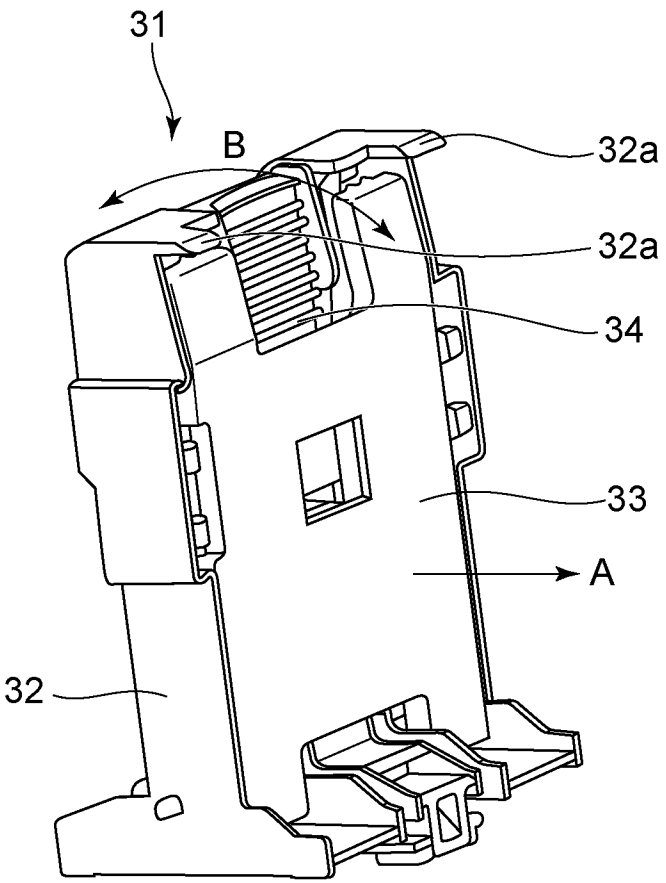
FIG. 3B is a perspective view of the trailing-end regulation unit in FIG. 3A viewed from the opposite side.
Figure 3A:
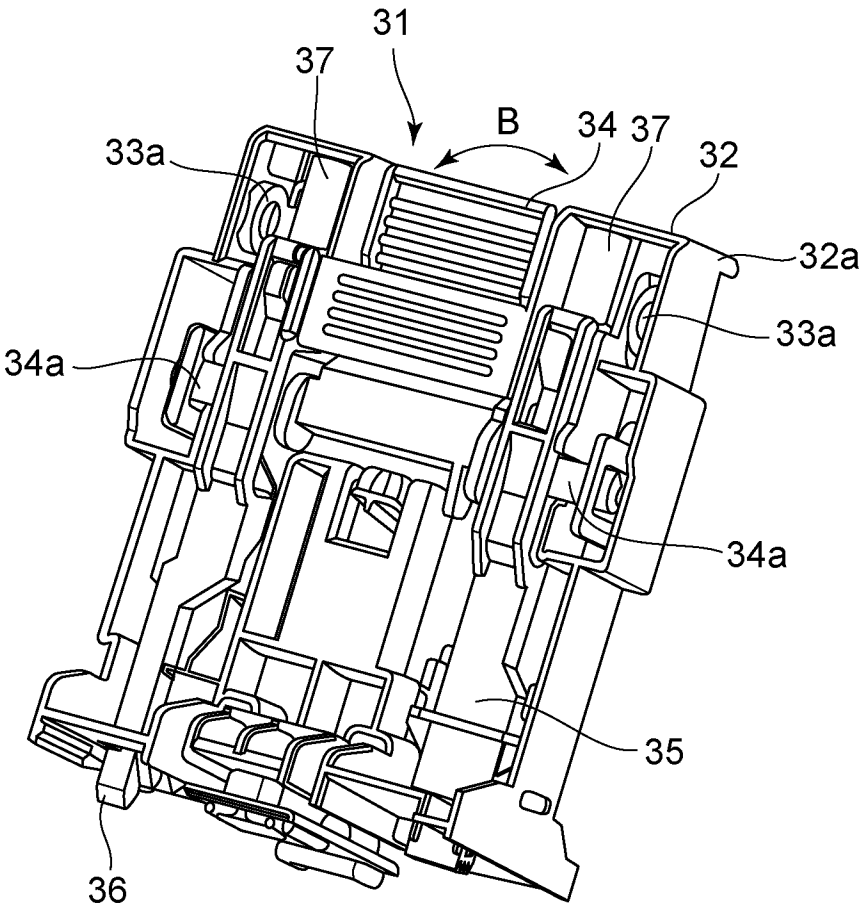
FIG. 3A is a perspective view of a trailing-end regulation unit according to a first embodiment of the present disclosure.

Next, the trailing-end regulation unit 31 will be described in outline. FIG. 3A is a perspective view of the trailing-end regulation unit 31 according to the first embodiment. FIG. 3B is a perspective view of the trailing-end regulation unit 31 in FIG. 3A viewed from the opposite side. Referring to FIGS. 3A and 3B, the trailing-end regulation unit 31 will be described. In FIGS. 3A and 3B, the trailing-end regulation unit 31 principally includes the trailing-end regulation holder 32, which is a first holding member. The trailing-end regulation holder 32 includes overload prevention claws 32*a*, at two positions, which are protruding members for the user to recognize that sheets are overloaded in the cassette 24.

Next, a trailing-end regulating pressing plate 33, which is a contact surface, will be described. The trailing-end regulating pressing plate 33 is urged under pressure in the direction of arrow A in FIG. 3B about a rotation support shaft 33*a* by an elastic member (not illustrated). The trailing end of the sheets stacked in the cassette 24 is urged and regulated by the pressing force. The second control lever 34 is provided at the trailing-end regulation holder 32 so as to be rotatable in the direction of arrow B in FIGS. 3A and 3B about a rotation support shaft 34*a*.

A nonstandard-size fixing member 35 is a second fixing member for fixing the trailing-end regulation unit 31 when nonstandard-size sheets are to be regulated. A standard-size fixing member 36 is a first fixing member for fixing the trailing-end regulation unit 31 when standard-size sheets are to be regulated. The nonstandard-size fixing member 35 and the standard-size fixing member 36 move in the vertical direction in cooperation with the movement of the second control lever 34.

Figure 4:
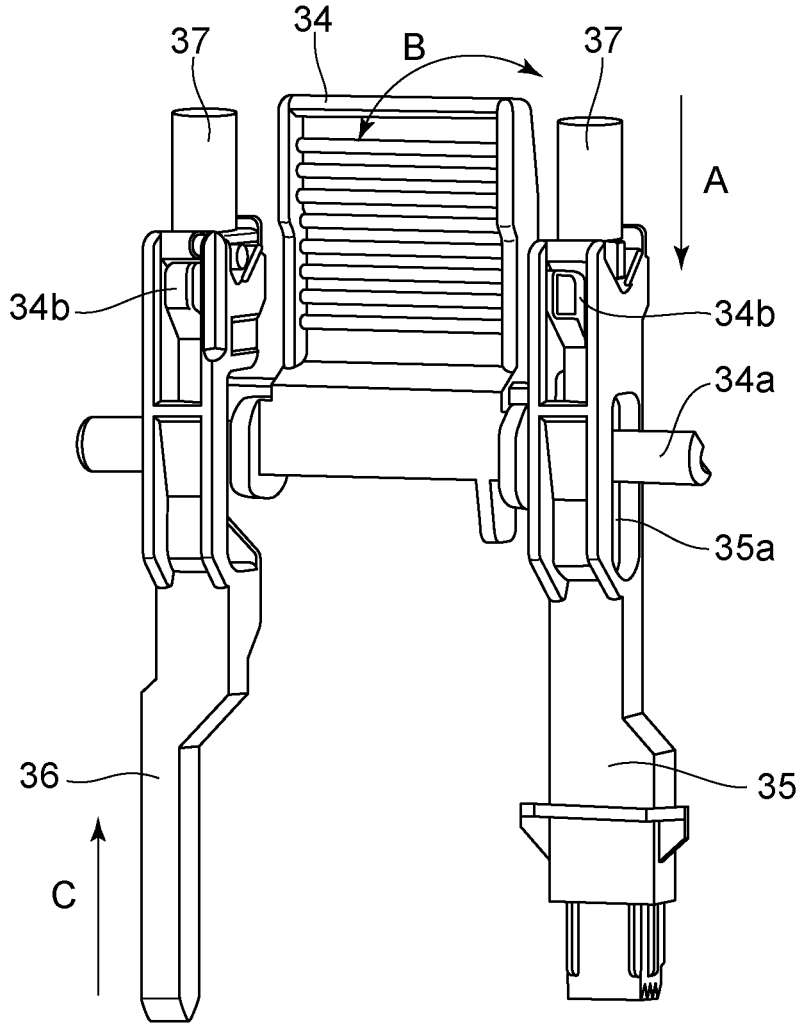
FIG. 4 is a perspective view of a nonstandard-size fixing member, a standard-size fixing member, and an operating member illustrating the engaging state thereof.

FIG. 4 is a perspective view of the nonstandard-size fixing member 35, the standard-size fixing member 36, and the second control lever 34 illustrating the engaging state thereof. FIG. 4 does not illustrate some components of the trailing-end regulation unit 31 to facilitate illustrating the engaging state. Referring to FIG. 4, the relationship between the nonstandard-size fixing member 35 and the standard-size fixing member 36 and the second control lever 34 will be described.

In FIG. 4, the nonstandard-size fixing member 35 has a long circular hole 35*a*. The second control lever 34 and the nonstandard-size fixing member 35 are combined, with the rotation support shaft 34*a* of the second control lever 34 inserted in the long circular hole 35*a*. The nonstandard-size fixing member 35 is held in the trailing-end regulation holder 32 so as to be movable up and down. This also applies to the engagement of the standard-size fixing member 36 and the second control lever 34. The nonstandard-size fixing member 35 and the standard-size fixing member 36 are each urged under pressure in the direction of arrow A in FIG. 4 by an elastic member 37.

When the second control lever 34 is rotated in the direction of arrow B in FIG. 4, the nonstandard-size fixing member 35 and the standard-size fixing member 36 are moved up in the direction of arrow C in FIG. 4 by cams 34*b* of the second control lever 34 against the pressing urging force of the elastic members 37. When the rotating operation on the second control lever 34 is stopped, the nonstandard-size fixing member 35 and the standard-size fixing member 36 are urged under pressure in the direction of arrow A in FIG. 4 by the pressing urging force of the elastic members 37 and are secured at predetermined positions.

Figure 5:
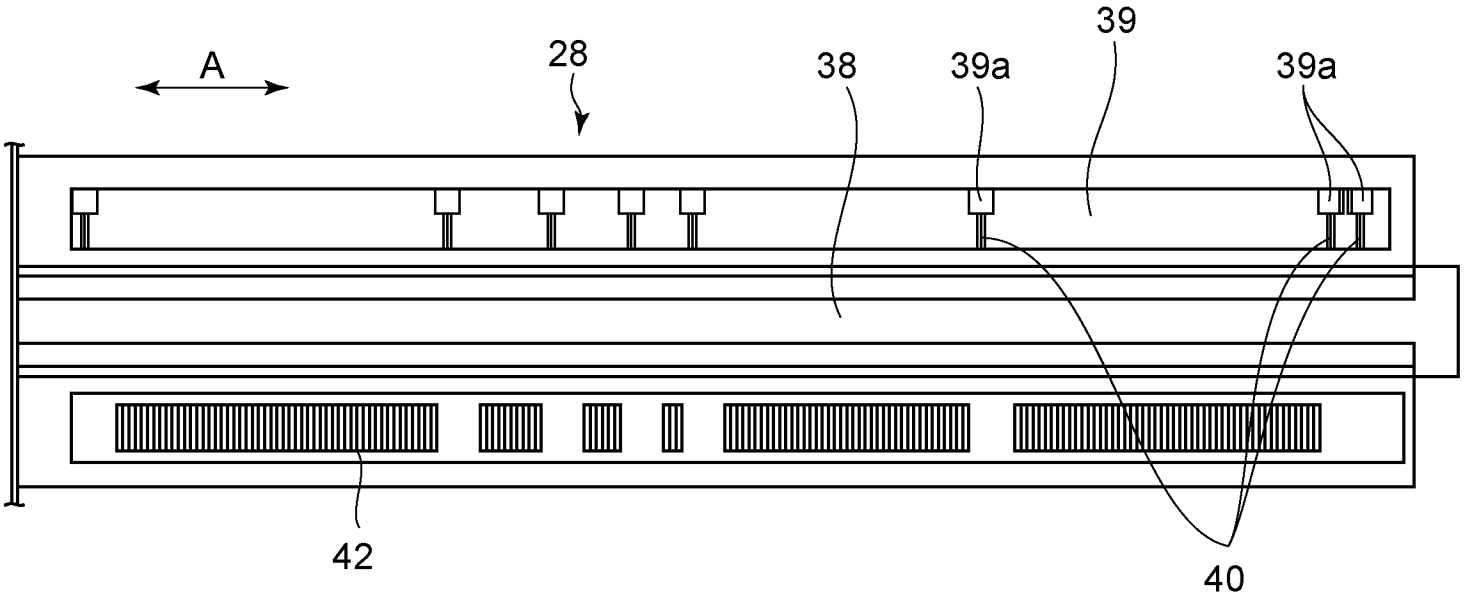
FIG. 5 is an enlarged top view of an engaged member of the trailing-end regulation unit.

Next, an engaged member of the cassette body 28 that engages with the nonstandard-size fixing member 35 and the standard-size fixing member 36 will be described. FIG. 5 is an enlarged top view of the engaged member of the trailing-end regulation unit 31 of the cassette body 28. Referring to FIG. 5, engagement of the cassette body 28 and the trailing-end regulation unit 31 will be described.

In FIG. 5, the trailing-end regulation unit 31 is movable in the direction of arrow A along a guide groove 38. As illustrated in FIG. 5, the cassette body 28 includes a first engaged member 39 and a second engaged member 42 parallel to the sheet feeding direction according to a predetermined rule.

The first engaged member 39 includes a plurality of engaged holes (hereinafter referred to as standard-size fixing holes) 39*a* to be used to fix the trailing-end regulation unit 31 in regulating standard-size sheets. The standard-size fixing holes 39*a* are provided at plurality of positions corresponding to standard sizes. A click groove 40 is provided next to each of the standard-size fixing holes 39*a*. Since the click grooves 40 are used to indicate that the trailing-end regulation unit 31 is at standard-size positions, the array interval is the same as the array interval of the standard-size fixing holes 39*a*. The click grooves 40 are disposed so as to engage with the claws (not illustrated) of the trailing-end regulation unit 31.

The second engaged member 42 includes a rack 42. The rack 42 is used to fix the trailing-end regulation unit 31 when the trailing-end regulation unit 31 regulates nonstandard-size sheets. The rack 42 is provided with fixed regularity so as to engage with pinions provided at the end of the nonstandard-size fixing member 35.

Figure 6A:
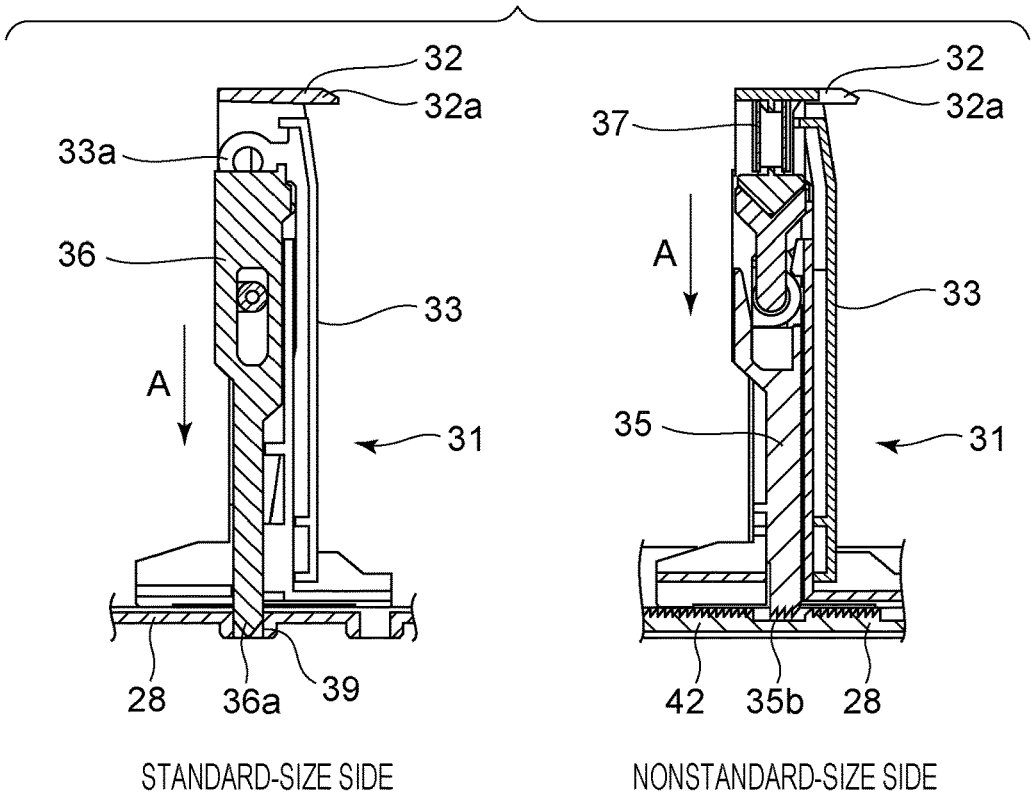
FIG. 6A is a cross-sectional view of the trailing-end regulation unit fixed to a standard-size position.
Figure 6B:
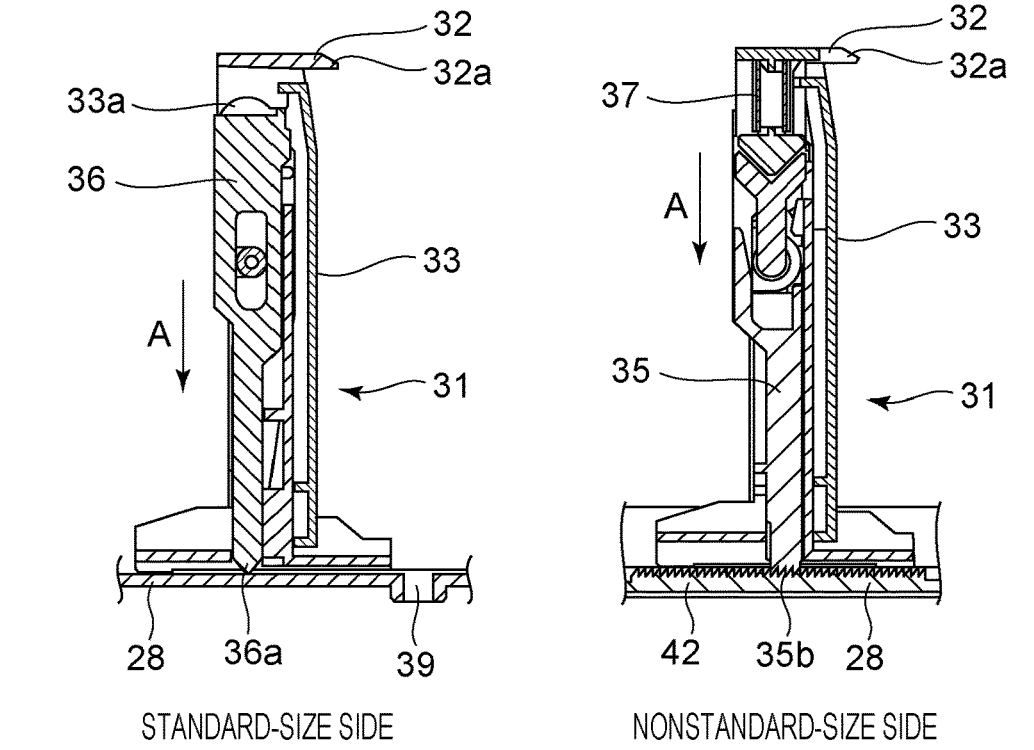
FIG. 6B is a cross-sectional view of the trailing-end regulation unit fixed to a nonstandard-size position.

FIG. 6A is a diagram illustrating the trailing-end regulation unit 31 fixed to a standard-size position. FIG. 6B is a diagram illustrating the trailing-end regulation unit 31 fixed to a nonstandard-size position. Referring to FIGS. 6A and 6B, a state in which the trailing-end regulation unit 31 is fixed to a standard-size and a nonstandard-size position will be described respectively.

In FIG. 6A, an end 36*a* of the standard-size fixing member 36 is fitted in a standard-size fixing hole 39*a* of the cassette body 28, so that the trailing-end regulation unit 31 is fixed not to move in the sheet conveying direction. An end 35*b* of the nonstandard-size fixing member 35 is positioned in an area of the cassette body 28 where the rack 42 is not present. As illustrated in FIG. 4, both of the fixing members 36 and 35 are urged under pressure downward in the direction of arrow A in FIG. 6A by the elastic members 37 (not illustrated on the standard-size side in FIG. 6A) into contact with predetermined abutment portions so as to be fixed in the vertical direction.

In FIG. 6B, the end 36*a* of the standard-size fixing member 36 is held in contact with a flat portion of the cassette body 28. Since the standard-size fixing member 36 is not fitted in the standard-size fixing hole 39*a* of the cassette body 28, a force of holding the position of the trailing-end regulation unit 31 is not generated. At that time, the end 35*b* of the nonstandard-size fixing member 35 is in contact to engage with the rack 42 of the cassette body 28. The nonstandard-size fixing member 35 is urged under pressure downward in the direction of arrow A in FIG. 6B by the elastic member 37, which causes a force of holding the position of the trailing-end regulation unit 31. As described above, the trailing-end regulation unit 31 of the first embodiment can be fixed at any position of a standard size or a nonstandard size with respect to the cassette body 28 by operating the second control lever 34.

Figure 7B:
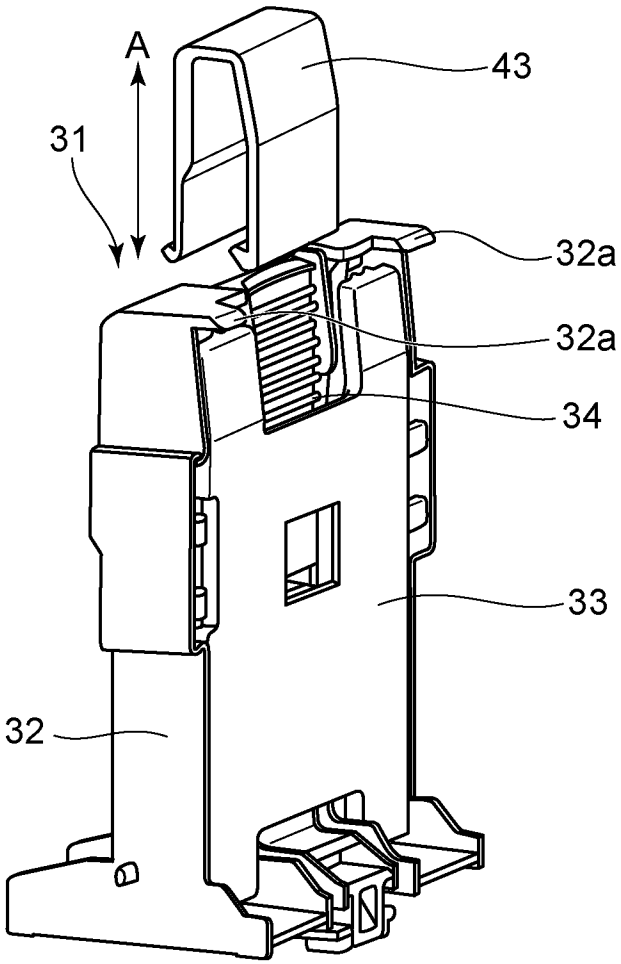
FIGS. 7A and 7B are perspective views of the trailing-end regulation unit for illustrating a protective cover
Figure 7A:
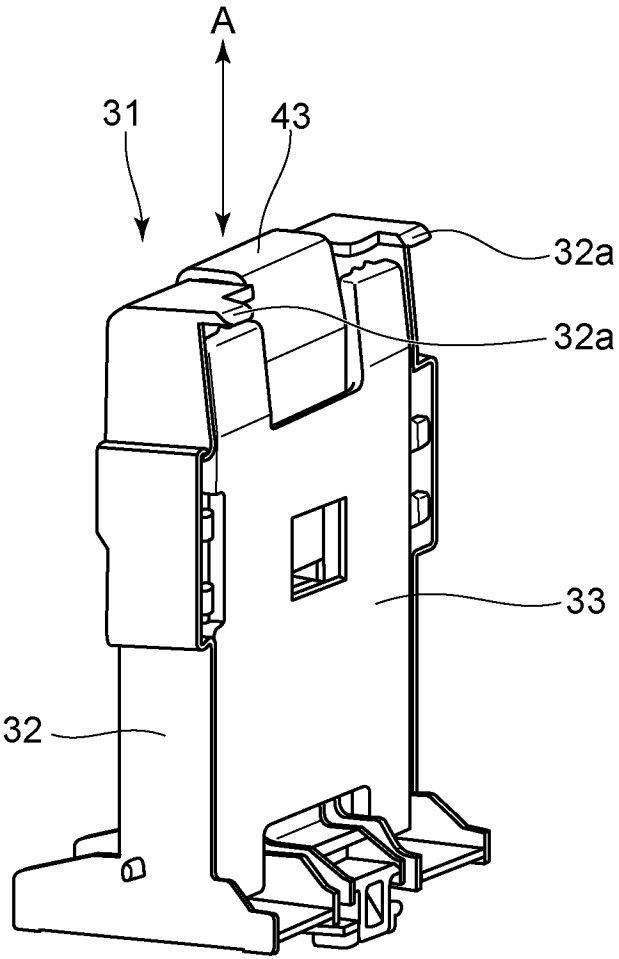

Next, a protective cover 43, which is a cover in the present embodiment, will be described. FIGS. 7A and 7B are perspective views of the trailing-end regulation unit 31 for illustrating the protective cover 43. In FIG. 7A, the second control lever 34 is covered by the protective cover 43, so that the second control lever 34 cannot be operated. The protective cover 43 is configured to be detachably attached to the trailing-end regulation unit 31 in the direction of arrow A.

Figure 8B:
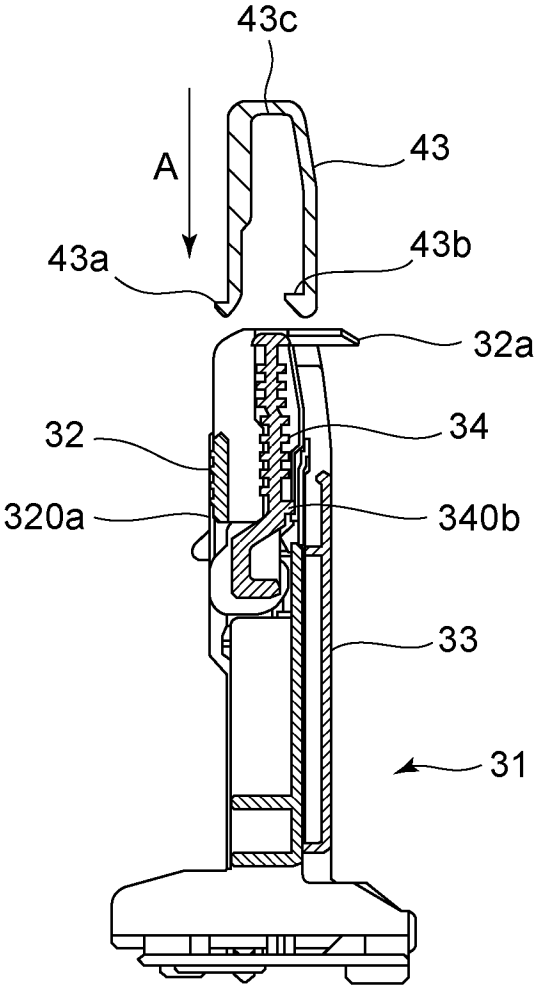
FIGS. 8A and 8B are cross-sectional views of the protective cover and the trailing-end regulation unit for illustrating the engaging states thereof.
Figure 8A:
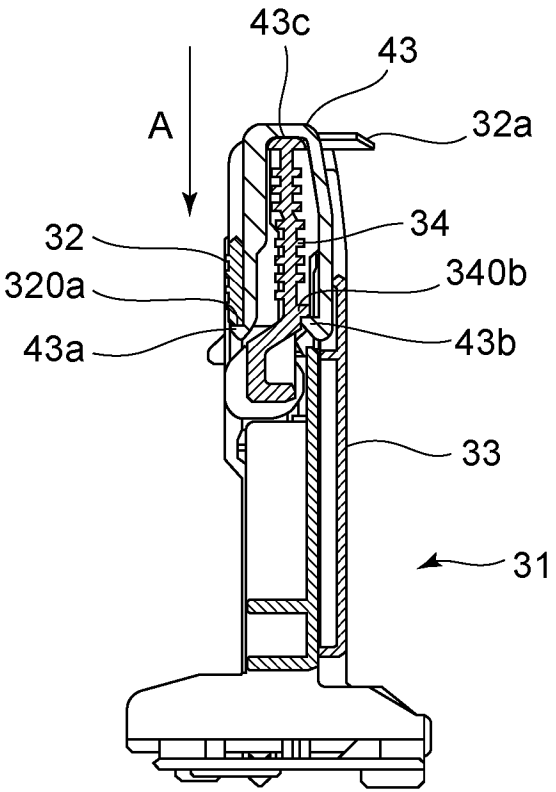

FIGS. 8A and 8B are cross-sectional views of the protective cover 43 and the trailing-end regulation unit 31 for illustrating engaging states thereof. Referring to FIG. 8B, the protective cover 43 includes a first hook 43*a*, a second hook 43*b*, and a top 43*c*. The trailing-end regulation holder 32 includes a first engaging portion 320*a* to engage with the first hook 43*a*, and the second control lever 34 includes a second engaging portion 340*b* to engage with the second hook 43*b*. In other words, the protective cover 43 engages with the second control lever 34 while engaging with the trailing-end regulation holder 32 to thereby restrict the rotational movement of the second control lever 34.

The protective cover 43 is attached from above the trailing-end regulation unit 31 in the direction of arrow A in FIG. 8A. The protective cover 43 is inserted into the trailing-end regulation unit 31 from above the trailing-end regulation unit 31 and stops at a position where the top 43*c* comes into contact with the second engaging portion 340*b* of the second control lever 34. In that state, the first hook 43*a* engages with the first engaging portion 320*a*, and the second hook 43*b* engages with the second engaging portion 340*b*.

As illustrated in FIGS. 7A and 7B and FIGS. 8A and 8B, the protective cover 43 is shaped so as not to protrude to the sheet stack side from the overload prevention claw 32*a* which is a protruding member, so as to be out of the way for the user to stack sheets in the cassette body 28. In other words, a flat surface of the protective cover 43 is flush with the trailing-end regulating pressing plate 33, and the overload prevention claw 32*a* protrudes from the flat surface of the protective cover 43.

The protective cover 43 is shaped so as not to protrude from the trailing-end regulating pressing plate 33 to the sheet stack side so that the trailing-end regulating pressing plate 33 can appropriately press and restrict the stacked sheets. When the first hook 43*a* and the second hook 43*b* are unhooked, the protective cover 43 can be detached from the trailing-end regulation unit 31.

Next, beneficial effects obtained by attaching the protective cover 43 to the trailing-end regulation unit 31 will be described. The protective cover 43 is attached to the trailing-end regulation unit 31 after the trailing-end regulation unit 31 is fixed to a predetermined position of the cassette body 28. Attaching the protective cover 43 to the trailing-end regulation unit 31 allows the second control lever 34 to cover the second control lever 34 to restrict the rotation of the second control lever 34. Since the second control lever 34 cannot be operated, the trailing-end regulation unit 31 is prevented from moving and can be kept in the fixed state.

Keeping the trailing-end regulation unit 31 in the fixed state prevents the user from unintentionally coming into contact with the second control lever 34 to displace the trailing-end regulation unit 31 during the work of loading sheets in the cassette 24 or the work of clearing a sheet jam. Without the protective cover 43, the user can unintentionally touch and move the second control lever 34, thereby moving the trailing-end regulation unit 31. This causes displacement of the trailing-end regulation unit 31, which causes displacement of the image forming position and a failure in conveying sheets.

In some case, the trailing-end regulation unit 31 fixed to the cassette body 28 may be provided to a user who performs image formation only on sheets of a specific standard size. This is for the purpose of preventing displacement of an image forming position or a failure in conveying sheets due to the unintended displacement of the trailing-end regulation unit 31.

In this case, for example, a dedicated securing unit (for example, a screw and a screw hole) may be provided to the trailing-end regulation unit 31 and the cassette body 28. This configuration requires the dedicated securing unit.

In the present embodiment, when the protective cover 43 is mounted, the movement of the second control lever 34 of the trailing-end regulation unit 31 is restricted by the protective cover 43, so that the trailing-end regulation unit 31 can be kept fixed to the cassette body 28.

Therefore, attaching the protective cover 43 to the trailing-end regulation unit 31 to prevent the user from operating the second control lever 34 may eliminate the need for fixing the trailing-end regulation unit 31 with a screw.

Although the trailing-end regulation unit 31 and the protective cover 43 that protects the second control lever 34 have been described, this configuration is not limited to the trailing-end regulation unit 31. The width regulation units 29 and 30 and the first control lever 44 may be given the same beneficial effects by using the same or similar designs and shapes for the second control lever 34, the first control lever 44, and peripheral components thereof. Using the same configuration for the width regulation units 29 and 30 and the trailing-end regulation unit 31 allows the same protective cover 43 to be attached. Using the protective cover 43 in common increases usability in attaching the protective cover 43.

Second Embodiment

The first embodiment illustrates a configuration for restricting the movement of a regulation unit that can be fixed to the cassette body 28 of the cassette 24, which is a sheet container, with a cover. A second embodiment illustrates a configuration for protecting an operating member for extending and retracting a sub-cassette body 28*b* which is an extension of the cassette 24, which is a sheet container, to and from a main cassette 28*a*. In the second embodiment, the same components as those of the first embodiment will be denoted by the same reference signs.

Figure 9A:
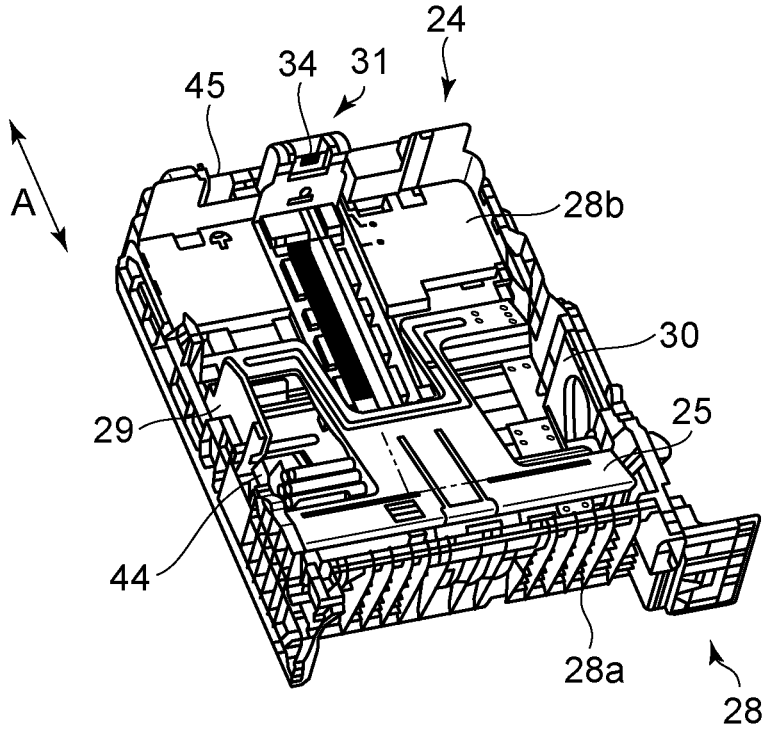
FIGS. 9A and 9B are perspective views of a sheet container according to a second embodiment of the present disclosure.
Figure 9B:
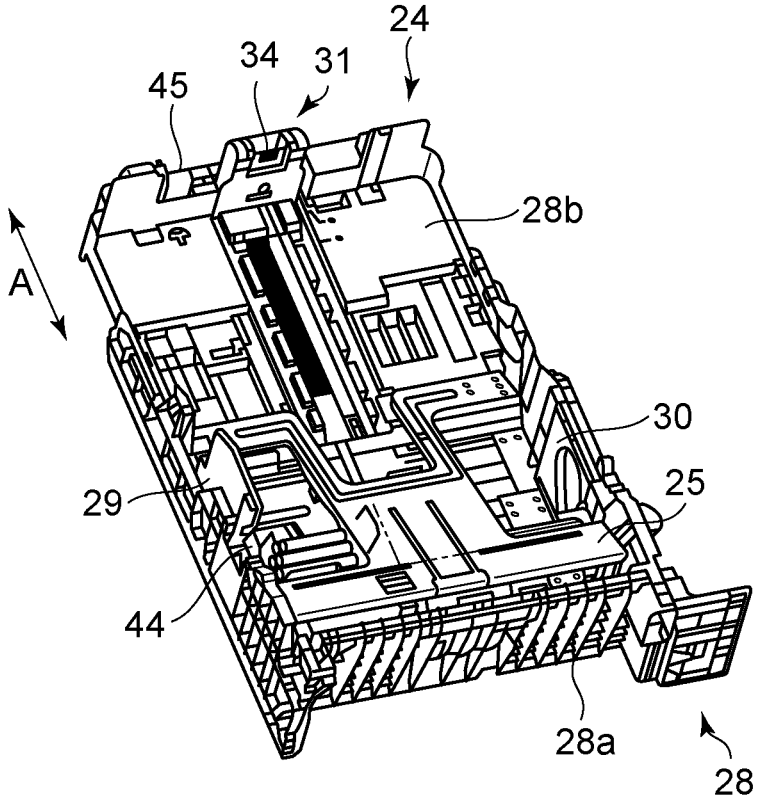

FIGS. 9A and 9B are perspective views of a cassette 24, which is a sheet container in the second embodiment. In FIGS. 9A and 9B, a cassette body 28 includes the main cassette body 28*a* which is a support unit and the sub-cassette body 28*b* which is an extension. The sub-cassette body 28*b* is configured to be extendable and retractable in the direction of arrow A in FIGS. 9A and 9B with respect to the main cassette body 28*a*. An extension and retraction control lever 45 is an operating member that is used to extend or retract the sub-cassette body 28*b*.

FIG. 9A illustrates the cassette 24, with the sub-cassette body 28*b* unextended. FIG. 9B illustrates the cassette 24, with the sub-cassette body 28*b* extended.

Figure 10B:
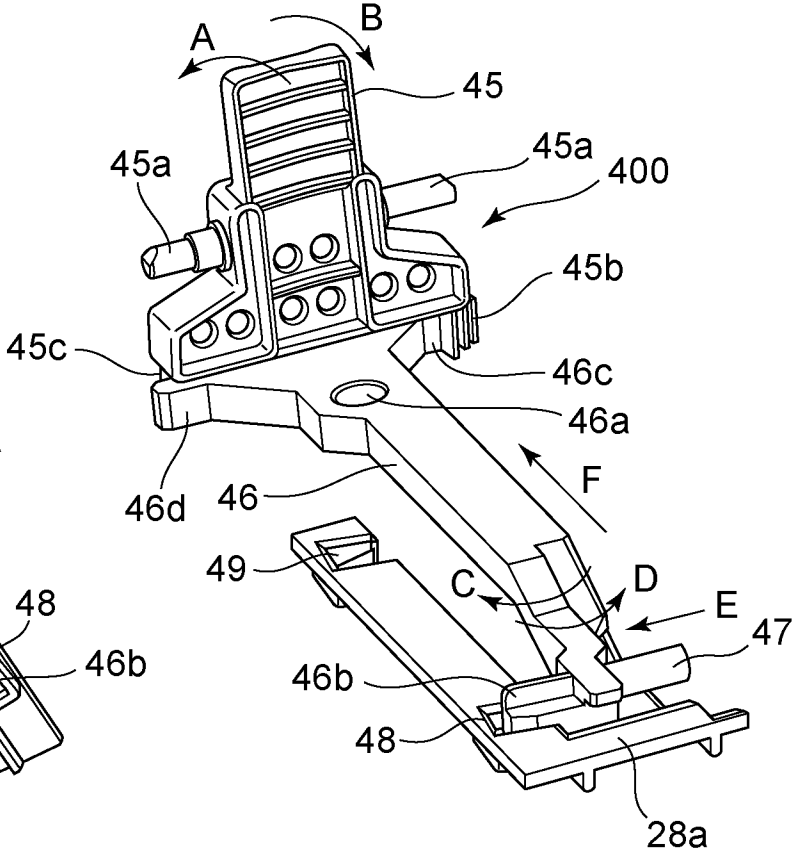
FIGS. 10A and 10B are enlarged perspective views of a locking mechanism according to the second embodiment.
Figure 10A:
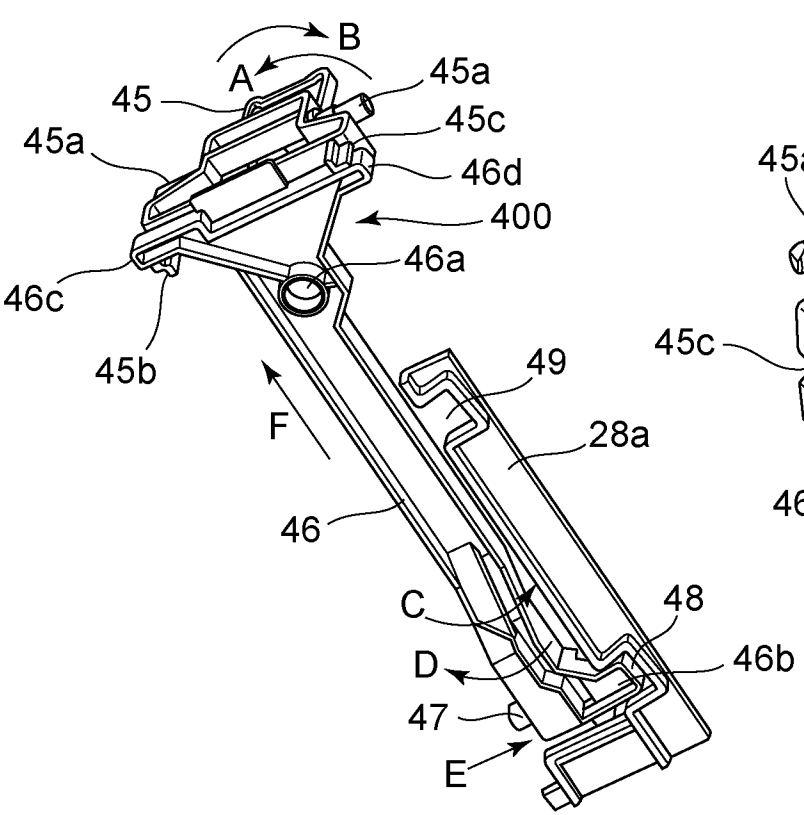

FIGS. 10A and 10B are perspective views of a locking mechanism 400 for locking the extended or retracted state of the sub-cassette body 28*b*. In FIGS. 10A and 10B, components other than some components related to the locking mechanism 400 that locks the extended or retracted state of the sub-cassette body 28*b* are omitted for ease of understanding. Referring to FIGS. 10A and 10B, the extending and retracting motion of the sub-cassette body 28*b* and the locking mechanism 400 will be described. FIG. 10A is a perspective view of the locking mechanism 400 viewed from the bottom. FIG. 10B is a perspective view of the locking mechanism 400 viewed from the top.

The locking mechanism 400 mainly includes an extension and retraction control lever 45, a locking lever 46 for locking the sub-cassette body 28*b*, and a locking-lever pressure spring 47.

The extension and retraction control lever 45 is mounted to the sub-cassette body 28*b* (not illustrated) so as to be pivotable about a pivot support shaft 45*a* in the directions of arrow A and arrow B in FIGS. 10A and 10B.

The locking lever 46 has a pivot support hole 46*a*. The locking lever 46 is mounted to the sub-cassette body 28*b* (not illustrated) so as to be pivotable in the directions of arrow C and arrow D in FIGS. 10A and 10B, with a pivot boss protruding from the sub-cassette body 28*b* fitted in the pivot support hole 46*a*. The locking lever 46 is urged in the direction of arrow E in FIGS. 10A and 10B by the locking-lever pressure spring 47.

A first locking groove 48 and a second locking groove 49 are provided in the main cassette body 28*a*. A fixing member 46*b* provided at an end of the locking lever 46 is engaged with the first locking groove 48 or the second locking groove 49, so that the sub-cassette body 28*b* is locked and held in the extended state or unextended state. When the fixing member 46*b* is in engagement with the first locking groove 48, the sub-cassette body 28*b* is not extended. When the fixing member 46*b* is in engagement with the second locking groove 49, the sub-cassette body 28*b* is extended.

The extension and retraction control lever 45 includes a first lever protrusion 45*b* and a second lever protrusion 45*c*. The locking lever 46 includes a first locking protrusion 46*c* and a second locking protrusion 46*d*. The first lever protrusion 45*b* and the first locking protrusion 46*c*, and the second lever protrusion 45*c* and the second locking protrusion 46*d* are each disposed so as to come into and out of contact with each other.

When the extension and retraction control lever 45 is pivoted in the direction of arrow A in FIGS. 10A and 10B, the second lever protrusion 45*c* presses the second locking protrusion 46*d* to pivot the locking lever 46 in the direction of arrow D in FIGS. 10A and 10B against the urging force of the locking-lever pressure spring 47. When the locking lever 46 pivots in the direction of arrow D in FIGS. 10A and 10B, the fixing member 46*b* comes out of the first locking groove 48 to allow the locking lever 46 to move in the direction of arrow F in FIGS. 10A and 10B.

When the extension and retraction control lever 45 is pivoted in the direction of arrow B in FIGS. 10A and 10B, the first lever protrusion 45*b* presses the first locking protrusion 46*c* to pivot the locking lever 46 in the arrow D in FIGS. 10A and 10B against the urging force of the locking-lever pressure spring 47. When the locking lever 46 pivots in the direction of arrow D in FIGS. 10A and 10B, the fixing member 46*b* comes out of the first locking groove 48 to allow the locking lever 46 to move in the direction of arrow F in FIGS. 10A and 10B.

The above is a description of a case in which the fixing member 46*b* engages with the first locking groove 48. This also applies to a case in which the fixing member 46*b* engages with the second locking groove 49. When the fixing member 46*b* and the second locking groove 49 are disengaged with each other, the locking lever 46 can move in the direction opposite to the direction of arrow F in FIGS. 10A and 10B.

Since the locking lever 46 is mounted to the sub-cassette body 28*b*, moving the locking lever 46 in the direction of arrow F in FIGS. 10A and 10B causes the sub-cassette body 28*b* to move together. This is the motion to extend the sub-cassette body 28*b*.

For any of extending and retracting motions, when the extension and retraction control lever 45 is released after the extending or retracting operation, the locking lever 46 moves in the direction of arrow C in FIGS. 10A and 10B by the urging force of the locking-lever pressure spring 47 and engages with the first locking groove 48 or the second locking groove 49 to be locked.

Figure 11A:
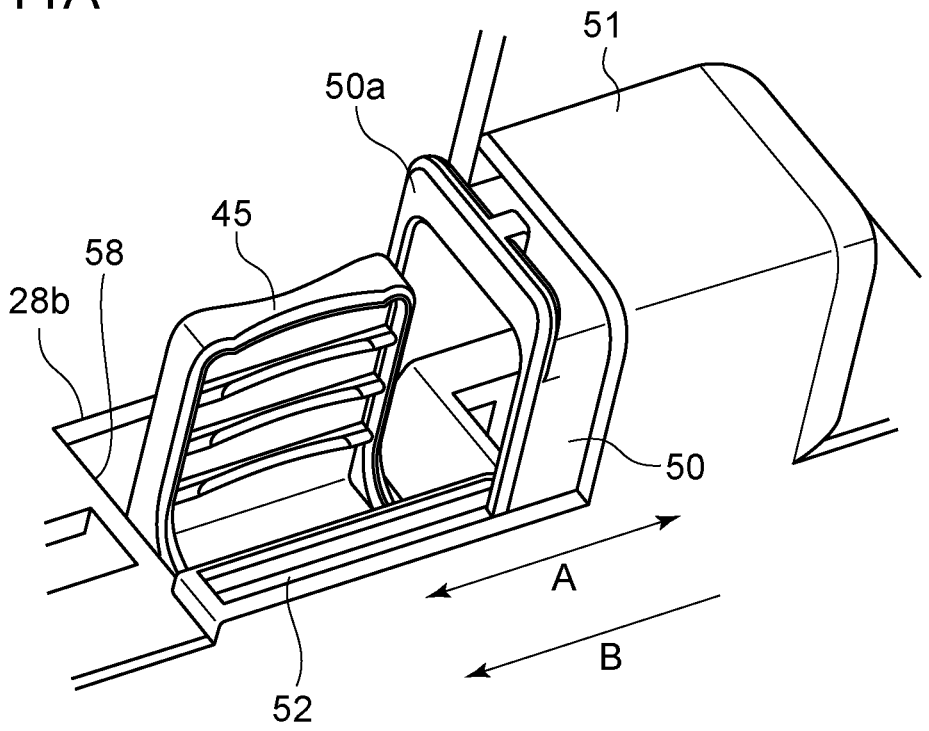
FIGS. 11A and 11B are enlarged perspective views of an operating member according to the second embodiment.
Figure 11B:
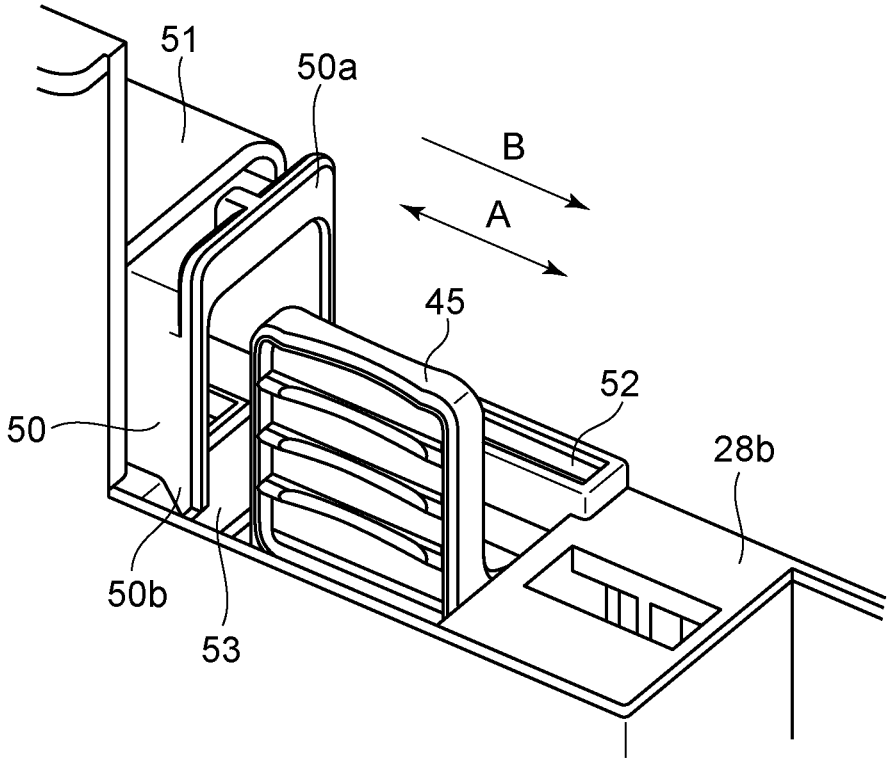
Figure 12A:
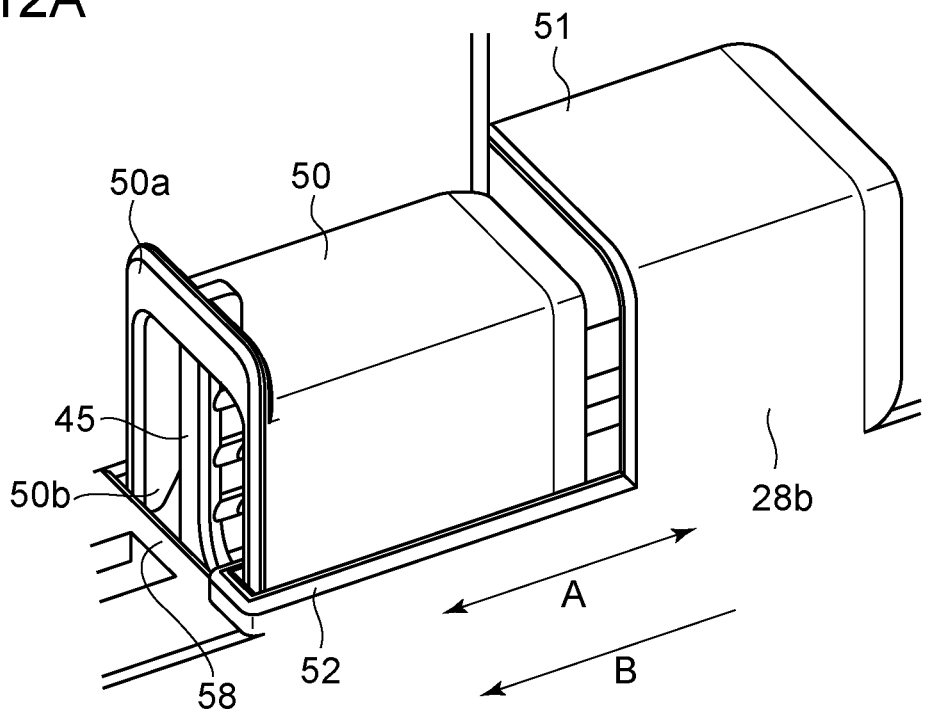
FIGS. 12A and 12B are diagrams illustrating the operating member according to the second embodiment in an inoperable state.
Figure 12B:
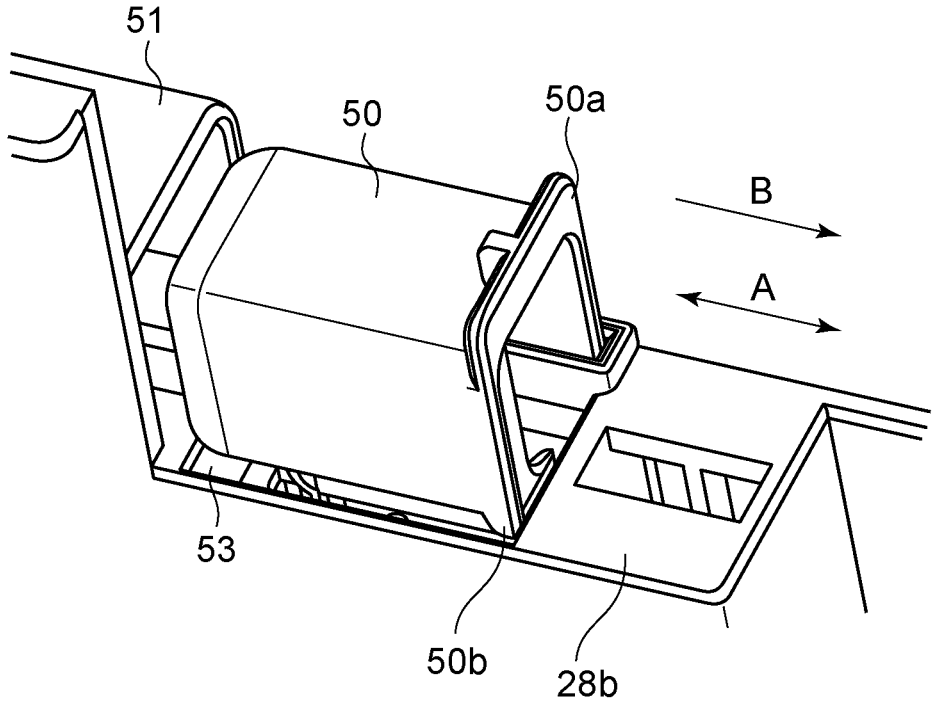

Next, a protective shutter 50, which is a cover in the present embodiment, will be described. FIGS. 11A and 11B and FIGS. 12A and 12B are perspective views of the extension and retraction control lever 45. FIGS. 11A and 11B illustrate a state in which the extension and retraction control lever 45 is operable. FIGS. 12A and 12B illustrate a state in which the extension and retraction control lever 45 is inoperable.

In FIGS. 11A and 11B and FIGS. 12A and 12B, a protective shutter 50 that protects the extension and retraction control lever 45 is used as a cover. The protective shutter 50 is mounted to the sub-cassette body 28*b* so as to be slidable in the direction of arrow A in FIGS. 11A and 11B and FIGS. 12A and 12B. The protective shutter 50 can be housed in a housing 51 provided on the sub-cassette body 28*b*.

When the user operates the extension and retraction control lever 45 to perform an operation of extending or retracting the sub-cassette body 28*b*, the protective shutter 50 is housed in the housing 51.

When the operation of extending or retracting the sub-cassette body 28*b* ends, the protective shutter 50 is drawn from the housing 51 to cover the extension and retraction control lever 45.

In housing or drawing the control lever protective shutter 50, the user holds a tab 50*a* of the protective shutter 50 and houses the protective shutter 50 in the housing 51 or draws the protective shutter 50 toward the extension and retraction control lever 45.

The protective shutter 50 is housed or drawn along a guide groove 52. The housing operation is completed when the protective shutter 50 abuts the inner wall of the housing 51 and an abutting portion 50*b* of the protective shutter 50 abuts a first wall surface 53 of an opening of the sub-cassette body 28*b*. The drawing operation is completed when the protective shutter 50 abuts an end of the guide groove 52, and the abutting portion 50*b* of the protective shutter 50 abuts a second wall surface 58 of the opening of the sub-cassette body 28*b*.

When the drawing operation is completed, the protective shutter 50 covers the extension and retraction control lever 45 to prevent operating the extension and retraction control lever 45. When the extension and retraction control lever 45 cannot be operated, the sub-cassette body 28*b* cannot be extended and retracted.

This prevents the user from unintentionally touching the extension and retraction control lever 45 to displace the sub-cassette body 28*b* when the user loads sheets in the cassette 24 or clears a sheet jam. This therefore prevents a decrease in printing accuracy due to the displacement of the sub-cassette body 28*b* and occurrence of sheet jamming.

The above is a description of an operation to draw the protective shutter 50 performed by the user. Alternatively, if an elastic member (not illustrated), such as a compression spring, is provided to the housing 51, the protective shutter 50 can be constantly urged in the direction of arrow B in FIGS. 11A and 11B and FIGS. 12A and 12B. With this configuration, when the user releases his/her hand after operating the extension and retraction control lever 45, the control lever protective shutter 50 is automatically pushed out to cover the extension and retraction control lever 45.

Providing the elastic member such as a compression spring ((not illustrated) prevents the user from forgetting to draw the control lever protective shutter 50.

Third Embodiment

The first embodiment illustrates a configuration for restricting the motion of the operating member for the regulation unit that can be fixed to the cassette body 28 of the cassette 24, which is a sheet container, using a cover. The first embodiment also illustrates a configuration in which the regulation unit is not fixed using a dedicated member such as a screw. A third embodiment illustrates a configuration in which the regulation unit is fixed to a support unit with a dedicated member, and the motion of the operating member for the regulation unit is restricted by a cover. In the third embodiment, the same components as those of the first embodiment will be denoted by the same reference signs for description. In the third embodiment, not the trailing-end regulation unit 31 but the width regulation unit 29 is illustrated as a regulation unit. The present embodiment may also be applied to the configuration of the trailing-end regulation unit 31 as in the first embodiment.

Figure 13B:
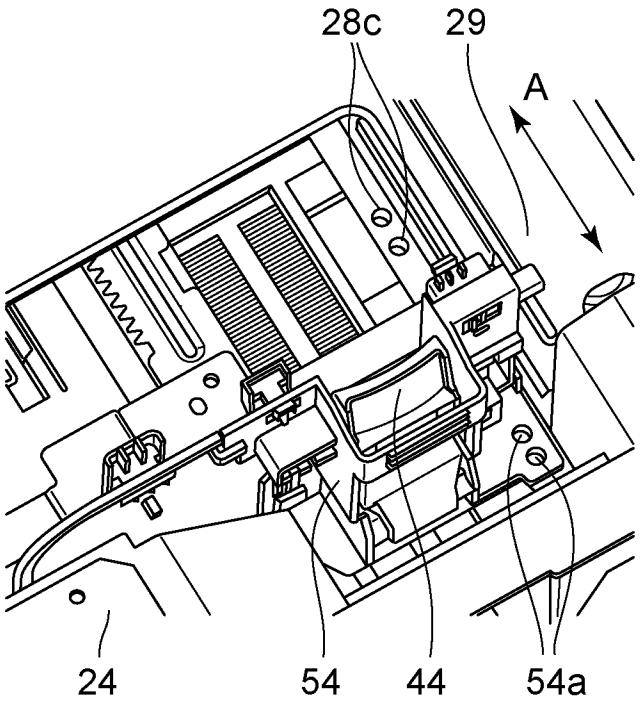
FIG. 13B is a perspective view of the operating member according to the third embodiment viewed from the back.
Figure 13A:
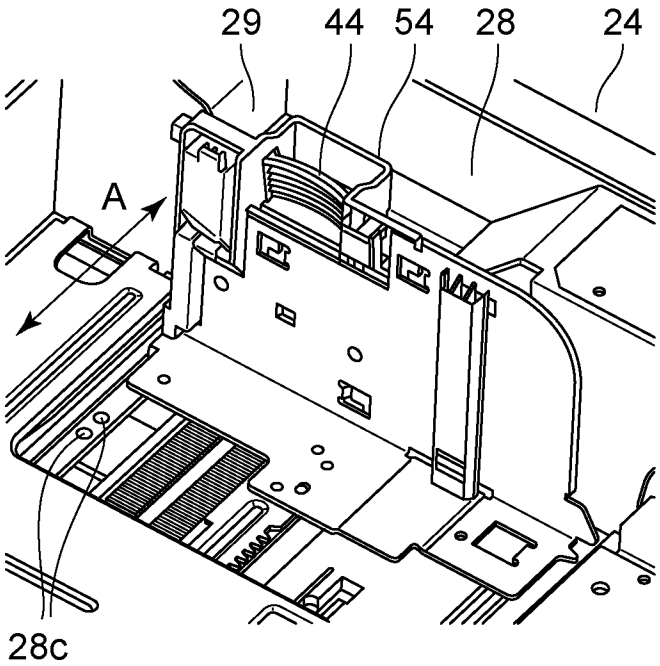
FIG. 13A is a perspective view of an operating member according to a third embodiment of the present disclosure viewed from the front.

FIGS. 13A and 13B are perspective views of the width regulation unit 29 in the third embodiment. FIG. 13A is a perspective view of a first control lever 44 viewed from the front, and FIG. 13B is a perspective view of the first control lever 44 viewed from the back.

In FIGS. 13A and 13B, the width regulation unit 29 is disposed so as to be movable in the direction of arrow A with respect to the cassette body 28. To move the width regulation unit 29, the first control lever 44 is operated to cancel the fixed state of the width regulation unit 29.

A width regulation holder 54 serving as a holding member has screw holes 54*a* which are positioning holes. The screw holes 54*a* face the cassette body 28. The screw holes 54*a* are used to align with lower holes 28*c* which are fixing holes of the cassette body 28. The width regulation holder 54 whose screw holes 54*a* are aligned with the lower holes 28*c* is fixed to the cassette body 28 using screws which are dedicated members. The number and positions of the lower holes 28*c* and the screw holes 54*a* depend on the size of the standard-size sheet, the width regulation unit 29, the cassette body 28, or other restrictions.

Figure 14B:
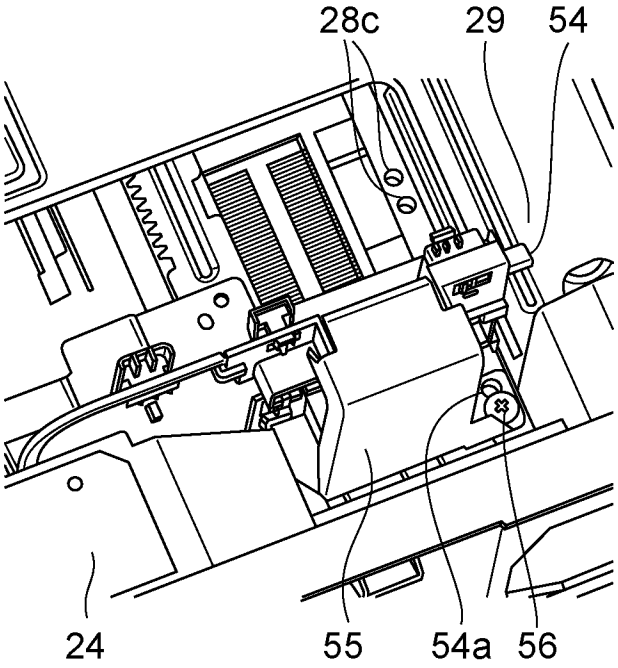
FIGS. 14A and 14B are perspective views of a regulation unit according to the third embodiment to which a cover is mounted.
Figure 14A:
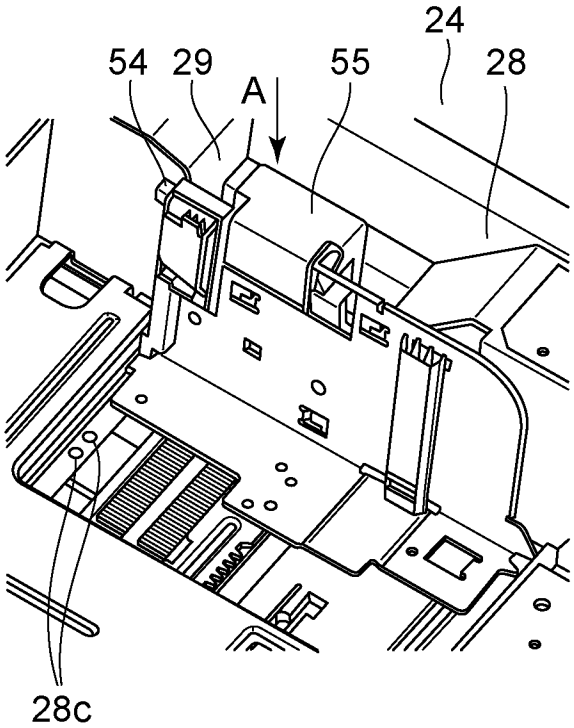

FIGS. 14A and 14B illustrate a state in which a protective block 55 serving as a cover is mounted to a first control lever 44 of the width regulation unit 29 in perspective view. The protective block 55 has screw holes, like the width regulation holder 54. The number and positions of the screw holes depend on the restrictions of the screw holes 54*a* of the width regulation holder 54 and the lower holes 28*c* of the cassette body 28, described above.

The width regulation unit 29 is moved and fixed to a position suitable for the standard size sheet stacked in the cassette body 28 by operating the first control lever 44. The protective block 55 is mounted to the width regulation unit 29 from above the width regulation unit 29 in the direction of arrow A in FIGS. 14A and 14B. After the protective block 55 is mounted to the width regulation unit 29 in a mount form (not illustrated), the protective block 55 and the width regulation holder 54 are fixed to the cassette body 28 with a screw 56. This configuration allows the width regulation unit 29 to be fixed to the cassette body 28 so as to be integrated with the protective block 55. As described in the first embodiment, the regulation unit may be used in a fixed state using a dedicated member depending on the intended use. In this case, if the operating member is exposed, operating the operating member to forcedly move the regulation unit may damage the regulation unit or disengage the regulation unit from the support unit.

In the configuration of the present embodiment, since the protective block 55 and the width regulation unit 29 are fixed using the screw 56, with the protective block 55 completely covering the first control lever 44, the width regulation unit 29 is reliably kept fixed.

In the above description, the protective block 55 is mounted to the width regulation unit 29. The protective block 55 may be mounted to cover the second control lever 34 in the first embodiment or the extension and retraction control lever 45 in the second embodiment. In those cases, the holding members for the regulation units may have positioning holes corresponding to the protective block 55.

Fourth Embodiment

The third embodiment illustrates a configuration in which the regulation unit and the cover are fixed to the support unit with a dedicated member. A fourth embodiment illustrates a configuration in which a cover is fixed to the regulation unit using a dedicated member. In the fourth embodiment, the same components as those of the first, second, and third embodiments will be denoted by the same reference signs for description. In the fourth embodiment, not the width regulation unit 29 but the trailing-end regulation unit 31 is illustrated as a regulation unit. The present embodiment may also be applied to the configuration of the width regulation unit 29.

Figures 15A, 15B, 15C:
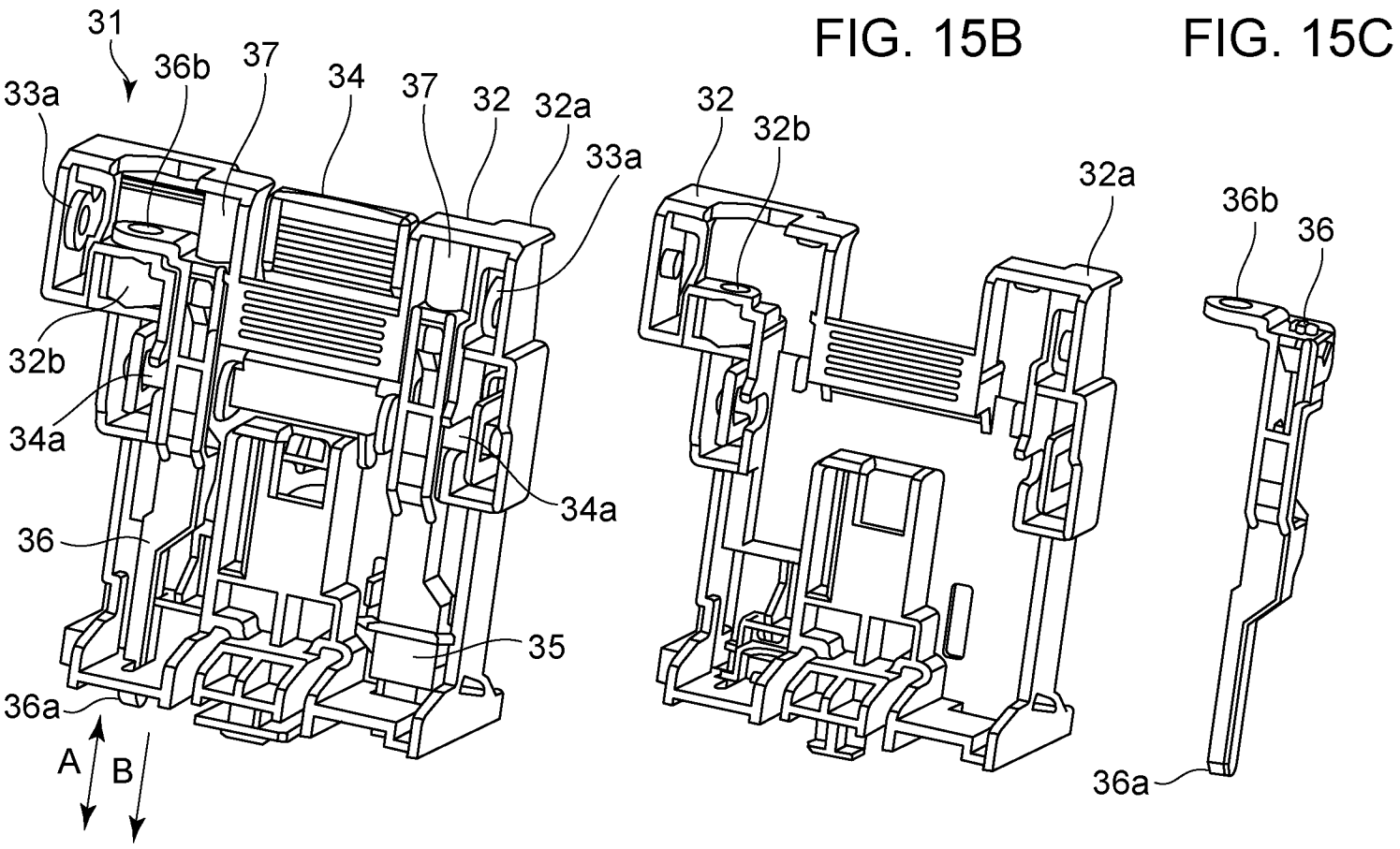
FIGS. 15A to 15C are perspective views of a regulation unit according to a fourth embodiment of the present disclosure.

FIGS. 15A to 15C are perspective views of the trailing-end regulation unit 31 of the present embodiment. FIG. 15A is an overall perspective view. FIG. 15B is a partly omitted diagram. FIG. 15C is an enlarged view of a standard-size fixing member 36. In FIGS. 15A to 15C, a trailing-end regulation holder 32 has a lower hole 32*b* which is a fixing hole for securing a screw which is a dedicated member. The standard-size fixing member 36 has a screw hole 36*b* which is a first positioning hole.

The standard-size fixing member 36 is mounted to the trailing-end regulation holder 32 so as to be vertically movable in the direction of arrow A in FIG. 15A by operating the second control lever 34 as described in the first embodiment. The standard-size fixing member 36 is urged in the direction of arrow B in FIG. 15A by the elastic member 37.

Figure 16B:
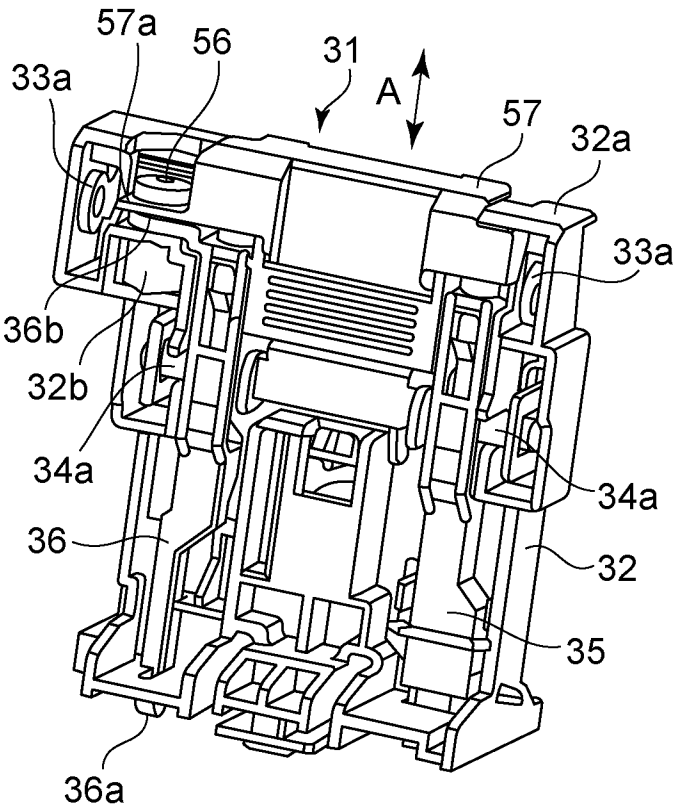
FIGS. 16A and 16B are perspective views of a cover and a regulation unit according to the fourth embodiment.
Figure 16A:
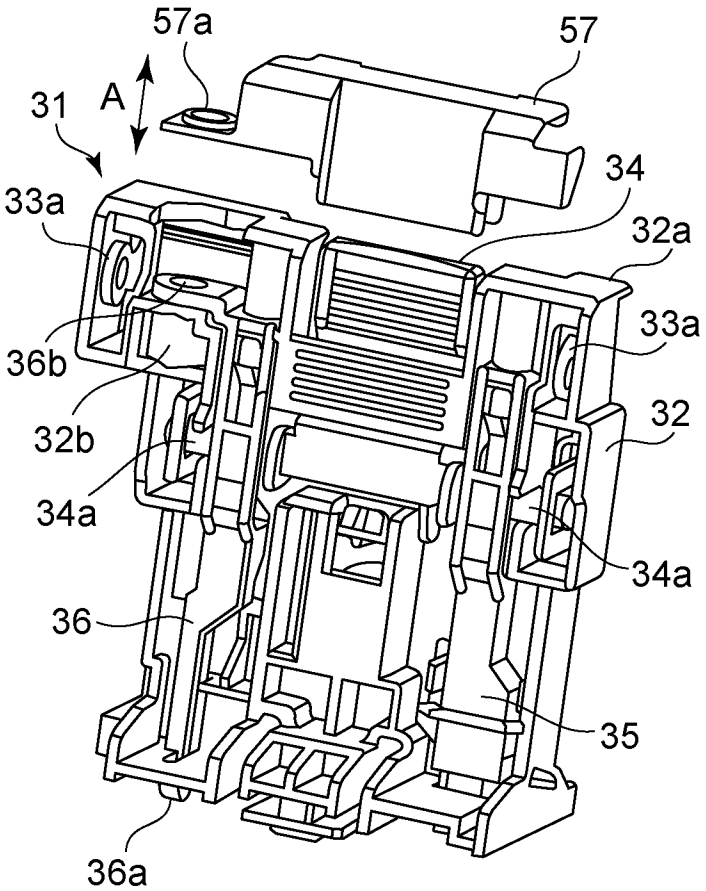

FIGS. 16A and 16B are perspective views of a protective piece 57, which is a cover in the present embodiment, and the trailing-end regulation unit 31. FIG. 16A illustrate a state before the protective piece 57 is mounted, and FIG. 16B illustrates a state after the protective piece 57 is mounted. The protective piece 57 is detachably mounted to the trailing-end regulation unit 31. The protective piece 57 is detachably mounted from above the trailing-end regulation unit 31 in the direction of arrow A in FIGS. 16A and 16B. The protective piece 57 has a screw hole 57*a* which is a second positioning hole.

When the trailing-end regulation unit 31 is moved to a predetermined standard-size position, the standard-size fixing member 36 is fitted in the standard-size fixing hole 39*a* of the cassette body 28, as described in the first embodiment. After the trailing-end regulation unit 31 is moved to the standard-size position, the protective piece 57 is mounted to the trailing-end regulation unit 31 from above the trailing-end regulation unit 31. By securing the screw 56 in the lower hole 32*b* through the screw hole 57*a* and the screw hole 36*b*, the protective piece 57 and the standard-size fixing member 36 are fixed to the trailing-end regulation holder 32.

This configuration allows the protective piece 57 to be fixed to the trailing-end regulation unit 31 while securing the trailing-end regulation unit 31 to the cassette body 28 with the standard-size fixing member 36. Since the cover that restricts the movement of the second control lever 34 is fixed to the trailing-end regulation unit 31 with the screw 56, with the trailing-end regulation unit 31 kept fixed, the trailing-end regulation unit 31 can be reliably kept fixed to the cassette body 28.

Figure 17:
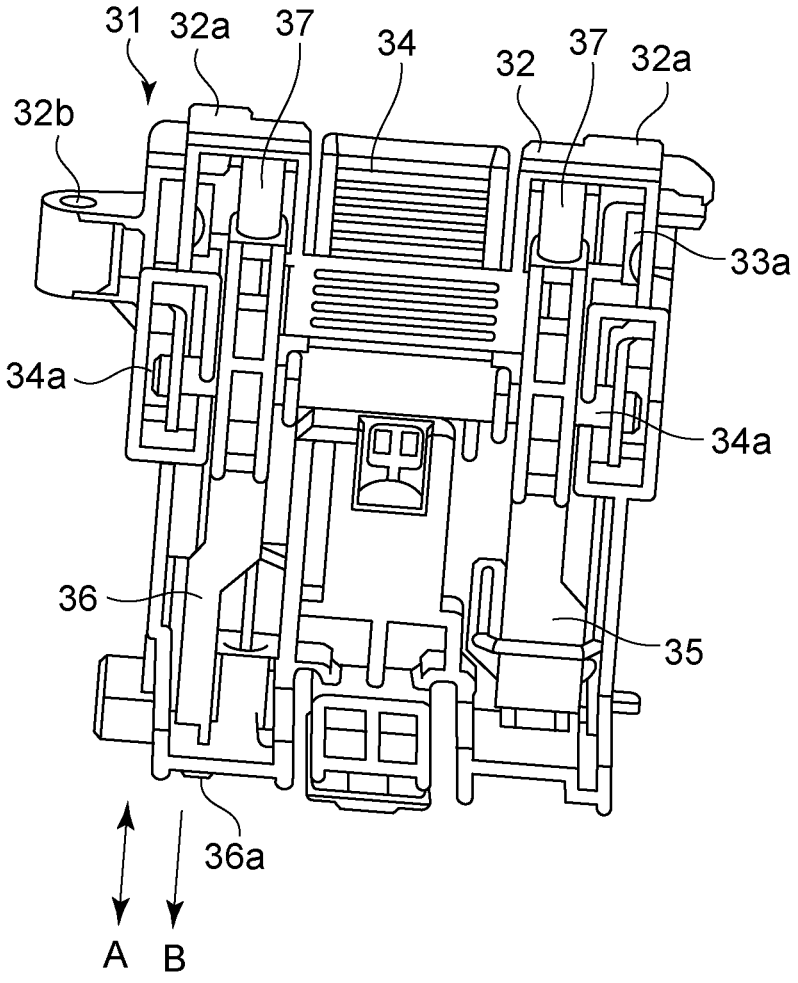
FIG. 17 is a perspective view of a modification of the fourth embodiment.

The protective piece 57 may be directly secured to the trailing-end regulation holder 32. FIG. 17 is a perspective view of a modification of the fourth embodiment. In FIG. 17, the trailing-end regulation holder 32 is disposed outside the frame of the trailing-end regulation holder 32 so that the lower hole 32*b* which is a fixing hole can come into direct-contact with the protective piece 57.

The protective piece 57 has a screw hole 57*a* which is a positioning hole so as to correspond to the lower hole 32*b*.

When the trailing-end regulation unit 31 is moved to a predetermined standard-size position, the standard-size fixing member 36 is fitted in the standard-size fixing hole 39*a* of the cassette body 28, as described in the first embodiment. After the trailing-end regulation unit 31 is moved to the standard-size position, the control-lever protective piece 57 is mounted to the trailing-end regulation unit 31 from above the trailing-end regulation unit 31. The control lever protective piece 57 is fixed to the trailing-end regulation holder 32 with a screw 56.

Figure 18B:
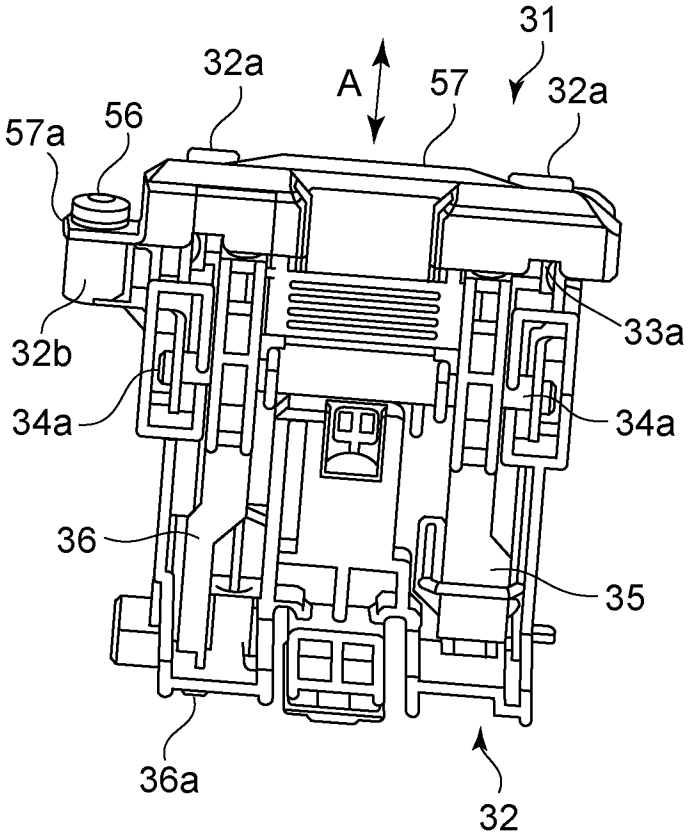
FIGS. 18A and 18B are perspective views of a cover and a regulation unit of the modification.
Figure 18A:
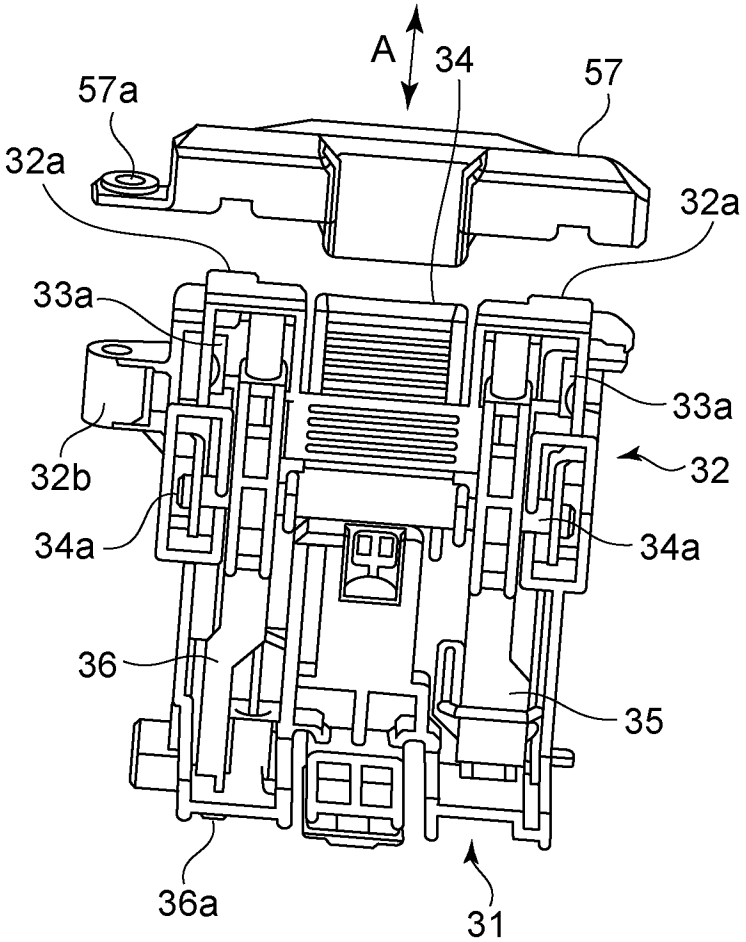

FIGS. 18A and 18B are perspective views of the protective piece 57 and the trailing-end regulation unit 31 in the modification. FIG. 18A illustrates a state before the protective piece 57 is mounted, and FIG. 18B illustrated a state in which the protective piece 57 is mounted. The configuration of the modification allows the protective piece 57 to be fixed to the trailing-end regulation holder 32 with the screw 56 without using the standard-size fixing member 36. Since the protective piece 57 restricts the movement of the second control lever 34, as in the other embodiments, the trailing-end regulation unit 31 can be kept fixed to the cassette body 28.

In the above embodiments, the cassette 24 detachably mounted to the image forming apparatus 1 is described as the sheet container. The sheet container may have a different configuration. For example, the present disclosure can also be applied to a trailing-end regulation unit and a width regulation unit that can be detachably mounted to a feeding unit that is optionally mounted to the image forming apparatus 1. The present disclosure can also be applied to a trailing-end regulation unit and a width regulation unit of an automatic document feeder.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

What is claimed is:

1. A sheet container to contain a sheet, the sheet container comprising:

a support unit including a plurality of engaged portions and having a surface on which the sheet is to be supported; and a regulation unit movable with respect to the support unit and having a surface configured to contact an end of the sheet to regulate the sheet in position, wherein the regulation unit includes an operating member to be operated, a holding member having structure to hold the operating member, a fixing member movable in cooperation with the operating member and having structure configured to contact one of the plurality of engaged portions, a contact surface configured to abut the end of the sheet, and a protruding member protruding from the holding member, wherein the operating member and the holding member are configured to be covered by a cover, wherein the fixing member is movable between an engaging position at which the fixing member engages with one of the plurality of engaged portions and a non-engaged position at which the fixing member does not engage with one of the plurality of engaged portions, wherein, in a state that the cover is mounted to the operating member and the holding member, the operating member is restricted from moving by the cover, and wherein, in the state that the cover is mounted to the operating member and the holding member, the protruding member protrudes from a parallel surface of the cover, and the parallel surface of the cover is a surface parallel to the contact surface.

2. The sheet container according to claim 1, wherein the holding member has a fixing hole, and the fixing member has a first positioning hole, and wherein the cover is fixed in the fixing hole with a screw through a second positioning hole of the cover and the first positioning hole of the fixing member.

3. The sheet container according to claim 1, wherein the holding member has a fixing hole, and wherein the cover is fixed in the fixing hole with a screw through a positioning hole of the cover.

4. The sheet container according to claim 1, wherein the operating member is rotatable with respect to the holding member, and wherein the fixing member moves vertically by rotation of the operating member.

5. The sheet container according to claim 1, wherein the protruding member is a member for regulating an amount of sheets loaded on the support unit.

6. The sheet container according to claim 1, wherein the parallel surface of the cover faces the sheet loaded on the support unit in the state that the cover is mounted to the operating member and the holding member.

7. The sheet container according to claim 6, wherein, when seen from a direction intersecting with a moving direction of the regulation unit, the contact surface is positioned between an end of the protruding member and the cover.

* * * * *